US012630970B2

(12) United States Patent
Ren et al.

(10) Patent No.: US 12,630,970 B2
(45) Date of Patent: May 19, 2026

(54) IRONING DEVICE

(71) Applicant: Shenzhen Tengben Technology Co., Ltd., Shenzhen (CN)

(72) Inventors: Chengzhu Ren, Shenzhen (CN); Qingyu Gao, Shenzhen (CN); Zhongming Yu, Shenzhen (CN)

(73) Assignee: Shenzhen Tengben Technology Co., Ltd., Shenzhen (CN)

( * ) Notice: Subject to any disclaimer, the term of this patent is extended or adjusted under 35 U.S.C. 154(b) by 0 days.

(21) Appl. No.: 19/251,712

(22) Filed: Jun. 26, 2025

(65) Prior Publication Data

US 2026/0132567 A1 May 14, 2026

Related U.S. Application Data

(63) Continuation-in-part of application No. 18/942,742, filed on Nov. 10, 2024, now Pat. No. 12,546,058.

(51) Int. Cl.

| | |
|---|---|
| ***D06F 75/18*** | (2006.01) |
| ***D06F 75/20*** | (2006.01) |
| ***D06F 75/26*** | (2006.01) |

(52) U.S. Cl.

CPC ..... *D06F 75/18* (2013.01); *D06F 75/20* (2013.01); *D06F 75/26* (2013.01)

(58) Field of Classification Search

CPC ..... D06F 75/08; D06F 75/10; D06F 75/14; D06F 75/22; D06F 75/24; D06F 75/30; D06F 75/18; D06F 75/20; D06F 75/26

See application file for complete search history.

(56) References Cited

U.S. PATENT DOCUMENTS

2022/0120028 A1* 4/2022 Sibeaud ..... D06F 75/24

FOREIGN PATENT DOCUMENTS

| | | | | | |
|---|---|---|---|---|---|
| CN | 113389029 A | * | 9/2021 | ..... | D06F 73/00 |
| CN | 216304248 U | * | 4/2022 | | |
| CN | 117904854 A | * | 4/2024 | ..... | D06F 73/00 |
| WO | WO-2024009012 A1 | * | 1/2024 | ..... | D06F 75/10 |

* cited by examiner

*Primary Examiner* — Nathan E Durham
(74) *Attorney, Agent, or Firm* — Che-Yang Chen

(57) ABSTRACT

An ironing device, includes a water tank, an ironing board having a steam area and an air suction area which is positioned under the steam area, a heating element for heating water from the water tank for generating steam which is discharged from the steam area, and an air suction fan for driving air suction through the air suction area of the ironing head.

9 Claims, 39 Drawing Sheets

IRONING DEVICE

CROSS REFERENCE OF RELATED APPLICATION

This application is a Continuation-In-Part application that claims the benefit of priority under 35U.S.C. § 120 to a non-provisional application, application Ser. No. 18/942,742, filing date Nov. 10, 2024, which is a non-provisional application that claims priority under 35U.S.C. § 119 to China application number CN 202323364794.3, filing date Dec. 8, 2023, wherein the entire content of which is expressly incorporated herein by reference.

BACKGROUND OF THE PRESENT INVENTION

Field of Invention

The present invention relates to technical field of household appliances, and more particularly to an ironing device.

Description of Related Arts

In today's society, an ironing equipment is a common household appliance in people's daily life. With the continuous development of science and technology, hanging ironing equipment is increasingly appearing in people's vision. In the prior art, the ironing device only has an ironing function, which is a single function and has poor applicability in multiple scenarios.

A conventional iron device may not meet safety regulations, particularly regarding electrical safety standards. This could make the device unsafe for consumers and lead to product recalls or legal issues. An iron panel might overheat, which can damage fabrics or increase the risk of fire or burns to the user.

In addition, a conventional ironing equipment either has a limited water tank capacity or have a large bulky size. The bulky equipment having a larger water storing capacity occupies more storage space, making it less convenient for those with limited space in their home or travel luggage, so that it is not ideal for compact storage or travel use.

Handheld ironing equipments are compact and easy to use. However, due to the absence of a garment support, the ironing panel does not adhere closely enough to the fabric, resulting in an ironing effect that falls far short of a traditional iron. To address this issue, an adsorption function is added to the ironing panel of the ironing equipment. This feature allows the steamer to firmly hold the fabric against the ironing panel during use, eliminating the need for a bulky ironing board while maintaining portability. Consequently, the ironing performance approaches that of a traditional iron, significantly enhancing the user experience.

Currently, ironing equipments with an adsorption function on the market generally have several disadvantages. The air outlet of most available adsorption garment steamers faces upward, placing it close to the user's face during operation. This results in high noise levels at the outlet and increases the likelihood of airflow blowing directly onto the user's face, negatively impacting the user experience.

The conventional adsorption ironing equipments do not separate steam from the adsorption function. The steam generated during ironing is directly drawn into the machine through the adsorption port and then expelled through the air outlet. If the steam volume is too high or the temperature is too high, there is a risk of facial burns. To mitigate this, most available adsorption ironing equipments use lower steam temperatures and reduced steam output, which compromises ironing performance, especially for garments that require high temperatures and large amounts of steam.

The layout of the steam and adsorption ports in conventional ironing equipment is often poorly designed. After ironing a specific area, the same section of fabric is immediately re-adsorbed by the machine. If the adsorption force is too strong, it can cause freshly ironed fabric to wrinkle again. To prevent this, manufacturers may reduce the suction power, but weaker suction compromises the adsorption effect, ultimately diminishing the overall ironing performance.

SUMMARY OF THE PRESENT INVENTION

The present application provides an ironing device, which can improve the multi-scenario applicability of the ironing device, assist users in achieving better ironing effects, and can reduce the parts of the ironing device, improve the simplicity of the equipment, and reduce costs.

In order to solve the above technical problems, the present application provides an ironing device, comprising:

- a water tank;
- an ironing board having at least one steam hole;
- a heating element for heating water from the water tank for generating steam which is discharged from the at least one steam hole; and
- a heat conductive piece arranged between the ironing board and the heating element to function as an insulator, wherein the heat conductive piece has at least one through hole which is aligned with the at least one steam hole of the ironing board.

According to an embodiment, a material of the heat conductive piece is selected from the group consisting of ceramic, thermally conductive silicone rubber, thermally conductive epoxy resin, and thermally conductive polymers.

According to an embodiment, the ironing device further comprises an inner shell, an outer shell, and a fan assembly, wherein the ironing board is provided with at least one ventilation hole, the inner shell is connected to the ironing board, and the heating element is provided in the inner shell to form a heating assembly, the outer shell is arranged on an outside of the inner shell, and an air duct communicated to the ventilation hole is formed between the outer shell and the inner shell, the fan assembly is arranged at one end of the air duct away from the ventilation hole.

According to an embodiment, the air duct comprises a first air duct, the outer shell comprises a first shell, the first air duct communicated to the at least one ventilation hole is formed between the first shell and the inner shell; the air duct comprises a second air duct, the outer shell comprises a second shell, and the second air duct communicated to the at least one ventilation hole is formed between the second shell and the inner shell; the fan assembly is arranged at an end of the first air duct away from the at least one ventilation hole and at an end of the second air duct away from the at least one ventilation hole.

According to an embodiment, the air duct comprises a ring-shaped air duct arranged around the heating assembly.

According to an embodiment, the fan assembly comprise a fan and a fan bracket, wherein the fan is arranged on the fan bracket, the inner shell and the outer shell are located on aside of the fan bracket away from the fan.

According to an embodiment, the inner shell and the ironing board are connected with each other in a taper fit.

According to an embodiment, the ironing device further comprises at least one sealing member, which is arranged on a side of the ironing board adjacent to the heating assembly and coaxially arranged with the at least one ventilation hole, and an end of the sealing member away from the ironing board is arranged in the air duct.

According to an embodiment, the inner shell comprises a third shell and a fourth shell, the third shell and the fourth shell form a accommodating cavity, the heating element is arranged in the accommodating cavity, a first air duct is formed between the third shell and the first shell, and a second air duct is formed between the fourth shell and the second shell, wherein the first shell and the third shell are integrally formed, and the second shell and the fourth shell are integrally formed.

According to an embodiment, the least one ventilation hole is arranged in a peripheral area of the ironing board and used as air inlet.

According to an embodiment, the ironing board has a plurality of the ventilation holes which are distributed along a peripheral area of the ironing board and used as air outlets.

According to an embodiment, the housing comprising a base housing portion and a head housing portion transversely connected to the base housing portion, wherein the water tank is detachably coupled to the base housing portion in a side-to-side manner.

According to an embodiment, the water tank comprises a tank body which comprises an upper portion which is arranged for being gripped by fingers of a hand of the user while the base housing portion is arranged for being held in a palm of the hand of the user.

According to an embodiment, the water tank comprises a tank body, wherein the tank body has a concave groove at an upper side thereof for placement of fingers of the hand of the user.

According to an embodiment, the water tank comprises a tank body and a seat tank portion extended from a lower side of the tank body, wherein the water tank is detachably mounted to the base housing portion in a manner that the base housing portion is supported above the seat tank portion at a side of the tank body.

According to an embodiment, the water tank comprises a locking unit for detachably coupling the water tank to the base housing portion, wherein the locking unit is hidden between the seat tank portion and the base housing portion.

According to an embodiment, the locking unit comprises a retention pin extended from the seat tank portion, a locking mechanism connected to the base housing portion, wherein the locking mechanism has a locking cavity with an access opening for allowing the retention pin to enter into the locking mechanism.

According to an embodiment, the retention pin comprises an inserting head, the locking mechanism comprises two locking members defining the locking cavity with the access opening, and two resilient elements connected to the two locking members respectively, wherein the inserting head of the retention pin is capable of being inserted into the locking cavity through the access opening.

According to an embodiment, the locking unit comprises a mounting pin which is protruded from the base housing portion, and a mounting base formed on the seat tank portion, wherein the mounting base is extending into the seat tank portion and has a mounting hole for engaging with the mounting pin.

According to an embodiment, a thermostat is arranged on the heating element to control the heating of the heating element.

The beneficial effects of the present application are as follows.

The ceramic heat conductive piece is positioned between the ironing board and the heating element, allowing it to efficiently transfer heat to warm the aluminum alloy ironing board while also acting as an insulator. This ensures complete electrical isolation between the ironing board and the heating element, eliminating the risk of electrical conduction and ensuring compliance with safety regulations The setting of the inner shell can lock the heat of the heating element, reduce the risk of heat loss due to heat exchange between the heating element and the wind in the air duct, improve the steam production efficiency of the heating element, and at the same time reduce the risk of excessive temperature of the outer shell due to heat radiation of the heating element; the inner shell outside the heating element cooperates with the outer shell to form an air duct connected to the vent, which can reduce the number of parts of the product, thereby reducing costs, and can form a more unified assembly structure for easy assembly; further, the fan assembly is arranged at one end of the air duct away from the vent, and according to the different positioning of the product, the ironing device can be targeted to add an air outlet function or an air intake function in addition to the steam ironing function, which can improve the multi-scenario applicability of the ironing device, and can assist users in achieving better ironing effects. Therefore, the present application can improve the multi-scenario applicability of the ironing device, assist users in achieving better ironing effects, and can reduce the parts of the ironing device, improve the simplicity of the equipment, and reduce costs.

According to another aspect, the present invention provides an ironing device, comprising:

- a water tank;
- an ironing head having a steam area and an air suction area which is positioned under said steam area;
- an evaporation assembly for heating water from the water tank for generating steam which is discharged from the steam area; and
- an air suction fan for driving air suction through the air suciton area of the ironing head.

According to an embodiment, a width of the steam area is smaller than a width of the air suction area.

According to an embodiment, the steam area has one or more steam holes, the air suction area comprises a plurality of partition ridges and a plurality of air suction holes each defined between two adjacent the partition ridges.

According to an embodiment, the ironing head comprises an ironing board having one or more steam holes to define the steam area and a head cover having a plurality of air suction holes to define the air suction area, wherein the ironing board is mounted to the head cover, the air suction holes are located under the ironing board.

According to an embodiment, a surface plane of the air suction area is positioned further back with respect to a surface plane of the steam area of the ironing board.

According to an embodiment, a plurality of the steam holes is arranged in a row, the plurality of air suction holes is arranged in a row and is positioned under the row of the plurality of steam holes.

According to an embodiment, an end of each of the partition ridge away from the evaporation assembly is positioned backward from a surface plane of the air suction area.

According to an embodiment, the steam area has one or more steam holes, the air suction area comprises a plurality of partition ridges and a plurality of air suction holes each defined between two adjacent the partition ridges, wherein an end of each of the partition ridge away from the evaporation assembly is positioned backward from the surface plane of the air suction area.

According to an embodiment, the ironing head further comprises a sealing ring mounted between the ironing head and the head cover.

According to an embodiment, the evaporation assembly comprises a heating element and a casing, wherein the heating element is disposed in the casing, wherein the ironing head is coupled to the casing to define a heating chamber between the ironing board and the casing to allow steam generated in the casing to enter the heating chamber to heat the ironing board.

According to an embodiment, the ironing head comprises a chamber cover, the casing of the evaporation assembly comprises an outlet wall having one or more steam outlet holes, the evaporation assembly comprises a surrounding wall extended from the outlet wall, the chamber cover is coupled to the surrounding wall of the evaporation assembly to define the heating chamber.

According to an embodiment, one or more steam outlet holes are formed at a lower portion of the outlet wall of the casing of the evaporation assembly.

According to an embodiment, the evaporation assembly further comprises a partition bar extended from the outlet wall at a position above the or or more steam outlet holes to divide the heating chamber into a lower chamber below the partition bar, an upper chamber above the partition bar, and two side passages between two ends of the partition bar and the surrounding wall for communicating the lower chamber to the upper chamber.

According to an embodiment, the chamber cover has one or more communication holes which is aligned with the one or more steam holes of the ironing board to communicate the heating chamber to the one or more steam holes.

According to an embodiment, the chamber cover has one or more communication holes which is aligned with the one or more steam holes of the ironing board to communicate the upper chamber of the heating chamber to the one or more steam holes.

According to an embodiment, the head cover has a through holet to allow the chamber cover to pass therethrough for coupling with the surrounding wall, the ironing board comprises a sealing wall around the steam area at a rear side thereof, the ironing head further comprises a sealing ring mounted between the sealing wall of the ironing head and the head cover at a position surrounding the chamber cover.

According to an embodiment, a filter element is detachably disposed between the air suction area of the ironing head and the air suction fan.

According to an embodiment, an air suction duct is disposed in a housing between the air suction area and the air suction fan.

According to an embodiment, the water tank is detachably coupled to the housing to define an air guiding passage between the water tank and a bottom of the housing, wherein one or more air discharge holes is formed between the water tank and the bottom of the housing.

According to an embodiment, the water tank comprises a tank body and seat tank portion connected to the tank body, wherein a height of the tank body is larger than a height of the seat tank portion, wherein the housing comprises a head part and a handle part transversely extended from the head part, wherein the air guiding passage is defined between the tank body and the seat tank portion of the water tank and a bottom of the handle part, wherein the tank body and the seat tank portion are detachably coupled to the bottom of the handle part of the housing, wherein the one or more air discharge holes is positioned between the seat tank portion and the bottom of the handle part of the housing.

According to an embodiment, the ironing device comprises a control assembly which comprises a control circuit board which is electrically connected to the evaporation assembly, the pump assembly and the air suction fan, a power switch electrically connected to the control circuit board for controlling on and off the ironing device, and an operation switch for controlling operation of the pump assembly and the air suction assembly, wherein when the power switch is turned on, the evaporation assembly is activated, when the operation switch is activated, the pump assembly and the air suction fan are in operation.

According to an embodiment, the operation switch is a capacitive sensing switch which is electrically connected to the control circuit board.

According to an embodiment, the operation switch comprises an sensing layer and a spring biasing against the sensing layer, wherein the spring is an electrical conductor that is electrically connected to the control circuit board.

Still further objects and advantages will become apparent from a consideration of the ensuing description and drawings.

These and other objectives, features, and advantages of the present invention will become apparent from the following detailed description, the accompanying drawings, and the appended claims.

BRIEF DESCRIPTION OF THE DRAWINGS

In order to more clearly illustrate the technical solutions in the embodiments of the present application, the following briefly introduces the drawings required for the description of the embodiments. Obviously, the drawings described below are only some embodiments of the present application. For ordinary technicians in this field, other drawings can be obtained based on these drawings without creative work.

DETAILED DESCRIPTION OF THE PREFERRED EMBODIMENT

The following will be combined with the drawings in the embodiments of the present application to clearly and completely describe the technical solutions in the embodiments of the present application. Obviously, the described embodiments are only part of the embodiments of the present application, not all of the embodiments. According to the embodiments in the present application, all other embodiments obtained by ordinary technicians in this field without creative work are within the scope of protection of this application.

The terms "first", "second", etc. in this application are used to distinguish different objects rather than to describe a specific order. In addition, the terms "include", "have" and any variations thereof are intended to cover non-exclusive inclusions.

It should be noted that when a certain element is fixed to another element, it includes directly fixing the element to the other element, or fixing the element to the other element through at least one other element in the middle. When an element is connected to another element, it includes directly connecting the element to the other element, or connecting the element to the other element through at least one other element in the middle.

Figure 1:
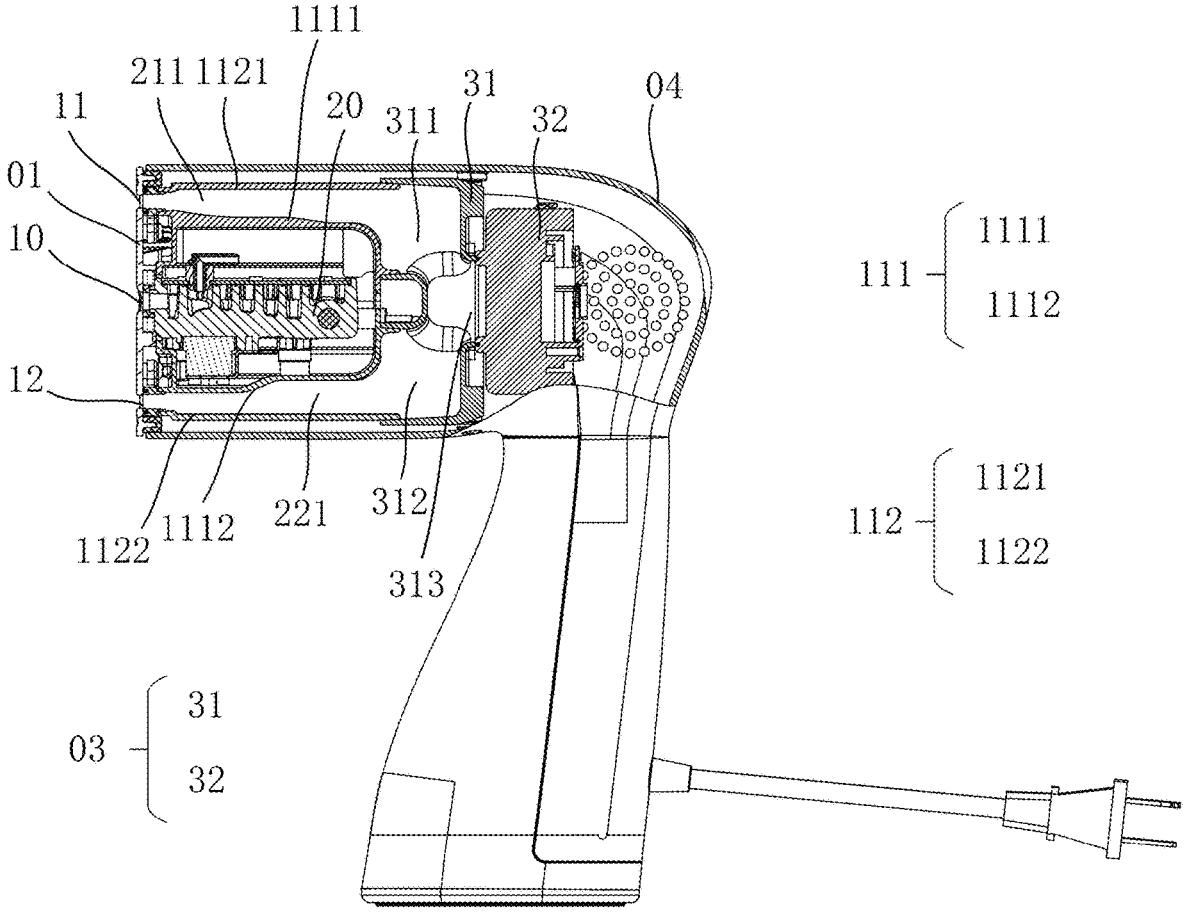
FIG. 1 is a schematic cross-sectional view of an ironing device according to an embodiment of the present application.
Figure 2:
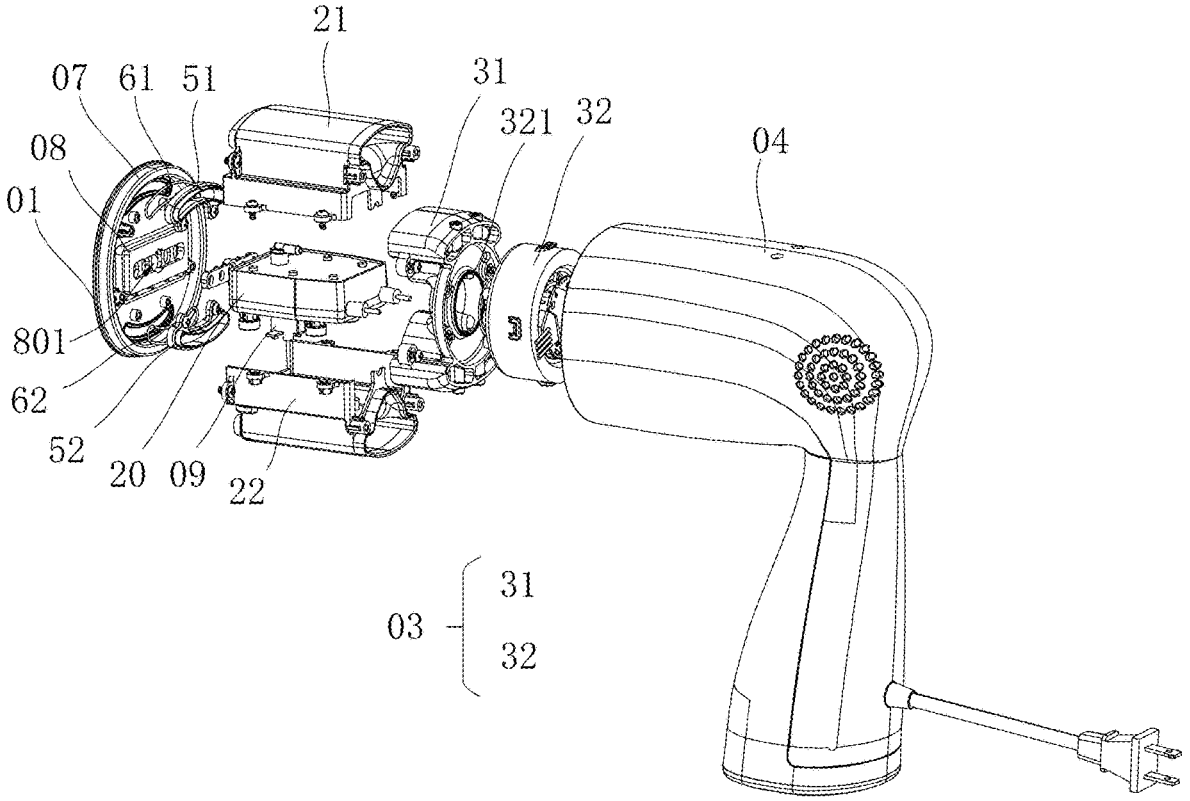
FIG. 2 is an exploded view of the ironing device according to the embodiment of the present application.
Figure 3:
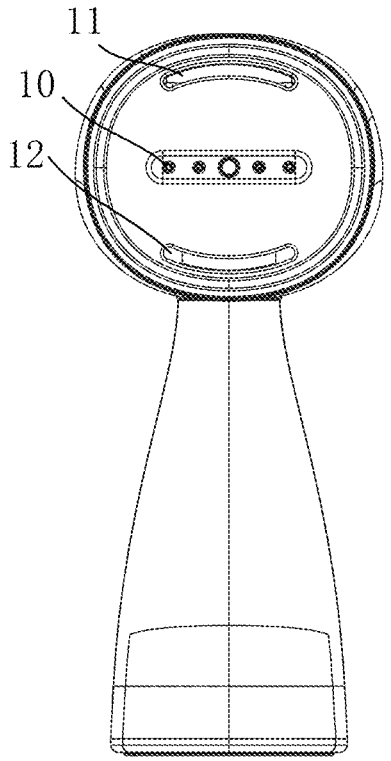
FIG. 3 is a front view of the embodiment of FIG. 2.
Figure 4:
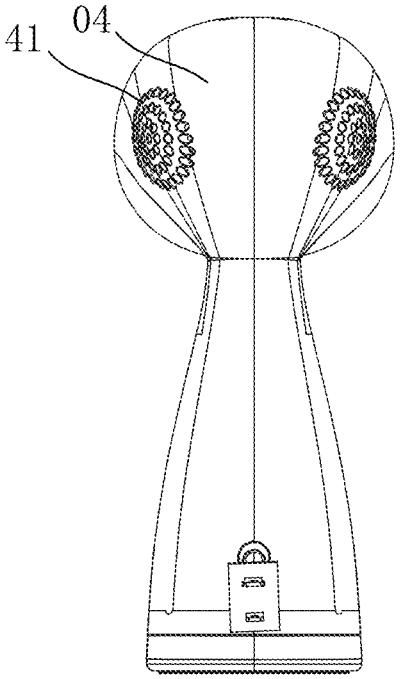
FIG. 4 is a rear view of the embodiment of FIG. 2.

The present application provides an ironing device, as shown in FIGS. 1 to 4, FIG. 1 is a schematic cross-sectional view of the ironing device according the embodiment of the present application; FIG. 2 is an exploded view of the ironing device according to the embodiment the present application; FIG. 3 is a schematic front view of the ironing device according to the embodiment of FIG. 2; and FIG. 4 is a schematic rear view of the ironing device according to the embodiment of FIG. 2. The ironing device comprises an ironing board 01, an inner shell 111, an outer shell 112, and a fan assembly 03. The ironing board 01 is provided with one or more ventilation holes and at least one steam hole 10; the inner shell 111 is connected to the ironing board 01, a heating element 20 coupled to the steam hole 10 is provided in the inner shell 111, and the inner shell 111 and the heating element 20 form a heating assembly; the outer shell 112 is arranged outside the inner shell 111, and an air duct communicated to the ventilation hole is formed between the outer shell 112 and the inner shell 111; and the fan assembly 03 is arranged at one end of the air duct away from the ventilation hole.

Specifically, the steam hole 10 is used to emit steam and can be used for ironing; the ironing board 01 is provided with ventilation holes to guide air, that is, air can flow out of the ironing board 01 through the ventilation holes, or air can flow into the ironing board 01 through the ventilation holes.

In one application scenario, the ventilation holes of the ironing device are set as air outlets, and air flows out of the ironing board 01 through the ventilation holes of the ironing device. After ironing, the ventilation holes can be used to dry the ironed clothes. For example, the user can press the ironing button component to iron, and after ironing, press the air outlet button component to blow air.

In another application scenario, the ventilation holes of the ironing device are set as air inlets, and air flows into the ironing board 01 through the ventilation holes of the ironing device. During the ironing process, the clothes can be sucked on the ironing board 01 through the ventilation holes. For example, in a hanging ironing device, the ventilation holes are set as air inlets to reduce the phenomenon that the clothes are blown away from the ironing board 01 due to the steam emitted by the steam hole 10, and the clothes can be attached on the ironing board 01, so that one-handed ironing can be achieved without pulling the clothes all the time during the ironing process, and the ironing effect and convenience can be improved, thereby improving the user experience.

The beneficial effect of the above arrangement is that the arrangement of the inner shell 111 can lock the heat of the heating element 20, reduce the risk of heat loss due to heat exchange between the heating element 20 and the wind in the air duct, improve the steam production efficiency of the heating element 20, and at the same time reduce the risk of excessive temperature of the outer shell 112 caused by the heat radiation of the heating element 20; the inner shell 111 outside the heating element 20 cooperates with the outer shell 112 to form an air duct connected to the vent, which can reduce the number of parts of the product, thereby reducing costs, and can form a more unified assembly structure for easy assembly; further, the fan assembly 03 is arranged at one end of the air duct away from the ventilation holes, and according to the different positioning of the product, the ironing device can be targeted to add an air outlet function or an air intake function in addition to the steam ironing function, which can improve the multi-scenario applicability of the ironing device and assist users in achieving better ironing effects. Therefore, this embodiment can improve the multi-scenario applicability of the ironing device, assist users in achieving better ironing effects, and can reduce the parts of the ironing device, improve the simplicity of equipment, and reduce costs.

Optionally, the inner shell 111 is made of a high temperature resistant material, and may be glass fiber reinforced plastic (eg, PBT+30% GF or PA66+30% GF).

Optionally, the air duct includes a first air duct 211, the outer shell 112 includes a first shell 1121, and the first air duct 211 communicated to the ventilation holes is formed between the fan assembly 03, the first shell 1121 and the inner shell 111, and the air duct includes a second air duct 221, the outer shell 112 includes a second shell 1122, and the second air duct 221 communicated to the ventilation holes is formed between the inner shell 111 and the second shell 1122; the fan assembly 03 is arranged at one end of the first air duct 211 away from the ventilation holes and at one end of the second air duct 221 away from the ventilation holes.

Specifically, the air duct may include only the first air duct 211, or may include only the second air duct 221, and the layout of the air duct may be adjusted as needed.

Optionally, the air duct includes an annular air duct arranged around the heating assembly.

Specifically, the air duct is arranged around the heating assembly, which can increase the volume of the air duct and improve the air suction effect or air discharge effect of the ironing device when it is in operation.

Optionally, the inner shell 111 comprises a third shell 1111 and a fourth shell 1112, the third shell 1111 and the fourth shell 1112 form a receiving cavity, the heating element 20 is provided in the receiving cavity, the first air duct 211 is formed between the third shell 1111 and the first shell 1121, and the second air duct 221 is formed between the fourth shell 1112 and the second shell 1122; the first shell 1121 and the third shell 1111 are integrally formed, and the second shell 1122 and the fourth shell 1112 are integrally formed.

The first shell 1121, the third shell 1111, the second shell 1122 and the fourth shell 1112 are covers forming the first air duct 211, the second air duct 221 and the accommodating cavity for accommodating the heating element 20. This design is simple to assemble and reduces the number of parts and components, thereby reducing costs. The first shell 1121 and the third shell 1111 are integrally formed, and the second shell 1122 and the fourth shell 1112 are integrally formed, which can reduce the difficulty of assembly and facilitate the production and assembly of the product. There is no need to produce additional air duct mechanism parts, which can reduce the number of product parts and components and can be directly demolded, thereby improving production efficiency, improving the structural reliability of the product, and improving the smoothness of gas flow, thereby reducing pressure loss along the gas flow process.

In other embodiments, based on the adjustment of the air duct structure or to improve the convenience of production, the first shell and the third shell can be designed with a detachable component setting, and the two can be sealed by a sealing glue.

In other embodiments, based on the adjustment of the air duct structure or to improve the convenience of production, the second shell and the fourth shell can be designed with a detachable component setting, and the two can be sealed by a sealing glue.

Optionally, the first air duct 211 is formed between the third shell 1111 and the first shell 1121, the third shell 1111 and the first shell 1121 form an upper shell 21, the second air duct 221 is formed between the fourth shell 1112 and the second shell 1122, the fourth shell 1112 and the second shell 1122 form a lower shell 22, and the upper shell 21 and the lower shell 22 are surrounded to form an accommodating cavity for accommodating the heating element 20.

Optionally, the upper shell 21 and the lower shell 22 may be connected by screws. In other embodiments, the connection between the two may be achieved by other means such as gluing, snapping, etc.

Optionally, the upper shell 21 and the lower shell 22 are made of heat-resistant materials. Since the working temperature of the heating element 20 is high, for example, up to about 180 degrees Celsius, the heat-resistant upper shell 21 and the lower shell 22 are required to wrap and fix the heating element 20.

Optionally, the first air duct 211 and the second air duct 221 are streamlined air ducts. The resistance encountered by an object when moving in a fluid is caused by two reasons: internal friction and vortex. When the speed is very small, the magnitude of the resistanceis mainly determined by the internal friction; when the speed is relatively large, it is mainly determined by the vortex. The faster the speed, the greater the effect of the vortex. The streamlined design can reduce the vortex effect or avoid the formation of the vortex, can greatly reduce the resistance, increase the gas flow speed, and reduce the pressure loss along the way, so as to improve the air outlet or air intake effect of the vent. For example, when the vent is an air inlet, this design can improve the adsorption effect of the vent on the clothes, thereby improving the ironing convenience of the ironing device and improving the ironing effect.

In other embodiments, the upper shell may include a first air pipe for forming the first air duct, and the lower shell may include a second air pipe for forming the second air duct. The first air pipe and the second air pipe may be flexible hoses.

Optionally, the air inlet of the fan assembly 03 is arranged near one end of the air duct away from the ventilation holes and is communicated to the air duct.

This arrangement allows the ventilation holes to serve as air inlet holes, thereby improving the adsorption effect of the ironing board 01 on clothes and reducing the phenomenon that clothes are blown away from the ironing board 01 due to steam emitted from the steam holes 10 during ironing. This allows one-handed ironing without the need to constantly pull clothes during the ironing process, and can improve the ironing effect and convenience, thereby improving the user experience.

Optionally, the air inlet of the fan assembly 03 is arranged adjacent to the first air duct 211 and the second air duct 221, and is communicated with the first air duct 211 and the second air duct 221.

The air inlet of the fan assembly 03 is adjacent to the first air duct 211 and the second air duct 221, and is communicated to the first air duct 211 and the second air duct 221, so that the air can be guided to the first air duct 211 and the second air duct 221 by one fan assembly 03, which can simplify the structure, improve the ease of assembly, and reduce costs; and this arrangement can make the first ventilation hole 11 and the second ventilation hole 12 as air inlet holes, which can improve the adsorption effect of the ironing board 01 on clothes, and reduce the phenomenon that clothes are blown away from the ironing board 01 due to steam emitted from the steam hole 10 during ironing, so that one-handed ironing can be achieved without pulling clothes all the time during the ironing process, and can improve the ironing effect and convenience, thereby improving the user experience.

In other embodiments, fan assemblies can also be provided separately for the first air duct and the second air duct. The first air duct and the second air duct are independent and non-conducting with each other, so as to increase the air flow speed of a single air duct, thereby improving the air flow rate of a single air duct. The air outlet or air inlet efficiency of a single air duct.

Optionally, the fan assembly 03 comprises a fan 32 and a fan bracket 31. The fan 32 is arranged on the fan bracket 31. The inner shell 111 and the outer shell 112 are located on the side of the fan bracket 31 away from the fan 32. At least one of a connection between the outer shell 112 and the fan bracket 31, and a connection between the inner housing 111 and the fan bracket 31 is provided with tapered fitting connection.

Taper fit refers to a mechanical fit used to connect two parts. Its main feature is the fit between the tapered shaft and the tapered hole. This matching method can significantly improve the assembly performance of parts, has good fault tolerance, and can reduce the dimensional tolerance requirements of parts. The assembly has good airtightness and facilitates the formation of sealed air passages.

In one application scenario, one end of the inner shell 111 adjacent to the fan bracket 31 abuts against the outer wall of the fan bracket 31 to achieve a tapered fit, and one end of the outer shell 112 adjacent to the fan bracket 31 abuts against the outer wall of the fan bracket 31 to achieve a tapered fit, which can achieve a tight connection and improve the air tightness of the air duct, so that the gas can smoothly enter the fan 32 through the air duct from the ventilation holes or flow out of the ventilation holes from the fan 32 through the air duct, thereby reducing the energy loss of the gas during the flow process; further, this fastening connection method is simple to assemble, simple and stable in structure, does not require unnecessary parts, and has good fault tolerance, can reduce the dimensional tolerance requirements of parts, can reduce costs, improve equipment efficiency, and improve product reliability.

In another application scenario, one end of the inner shell 111 adjacent to the fan bracket 31 abuts against the outer wall of the fan bracket 31 to achieve a taper fit, and the outer shell 112 can be airtightly connected to the fan bracket 31 in other ways (such as sealant); in another application scenario, one end of the outer shell 112 adjacent to the fan bracket 31 abuts against the outer wall of the fan bracket 31 to achieve a taper fit, and the inner shell 111 can be airtightly connected to the fan bracket 31 in other ways (such as sealant). No specific limitation is made here.

Optionally, the inner shell 111 is connected to the ironing board 01 by a taper fit. In an application scenario, one end of the inner shell 111 adjacent to the ironing board 01 abuts against the ironing board 01 to achieve a taper fit, which can achieve a tight connection, improve the air tightness of the air duct, and allow the gas to smoothly enter the air duct from the vent or flow out of the vent, reducing the energy loss of the gas during the flow process; further, this fastening connection method is simple to assemble, has a simple and stable structure, does not require redundant parts, and has good fault tolerance, can reduce the dimensional tolerance requirements for parts, can reduce costs, improve equipment efficiency, and improve product reliability.

Optionally, the fan bracket 31 forms an air cavity, which is provided with a first air outlet communicated to the air duct and a second air outlet 313 communicated to the fan; the outer shell 112 and the inner shell 111 are arranged outside the first air outlet at one end adjacent to the fan bracket 31, and abut against the outer wall of the first air outlet.

The beneficial effect of the above arrangement is that the outer shell 112 and the inner shell 111 abut against the outer wall of the first air blast port to form a closed air cavity without the need for an additional air duct mechanism, thereby simplifying the structure of the ironing equipment, reducing parts, and lowering assembly costs and efficiency.

Optionally, the outer shell 112 and the inner shell 111 abut against the outer wall of the first air outlet to form a tapered fit, which can achieve a tight connection and improve the air tightness of the air duct, so that the gas can smoothly enter the first air vent from the air duct or flow into the air duct from the first air vent.

Optionally, the air outlet of the fan assembly 03 is arranged near one end of the air duct away from the ventilation holes and is communicated to the air duct.

This setting can make the ventilation holes serve as air outlets, so that the ironing device can have a targeted air outlet function in addition to the steam ironing function, thereby improving the multi-scenario applicability of the ironing device and helping users achieve better ironing effects, thereby improving the user experience.

Optionally, the cross-sectional size of the air duct gradually increases from the ventilation holes to the air outlet.

This arrangement can increase the wind force when the air is gathered from the fan 32 to the ventilation holes through the air duct, thereby improving the air outlet effect.

Optionally, the fan assembly 03 comprises the fan 32 and the fan bracket 31, the fan bracket 31 is arranged between the fan 32 and the upper shell 21 and the lower shell 22, and forms an air cavity, the air cavity is provided with a first sub-air outlet 311 communicated to the first air duct 211, a second sub-air outlet 312 communicated to the second air duct 221 and the second air outlet 313 communicated to the fan 32.

Optionally, the ventilation holes comprises the first ventilation hole 11 and the second ventilation hole 12, the first ventilation hole 11 is communicated with the first air duct 211, and the second ventilation hole 12 is communicated with the second air duct 221.

Specifically, when the first ventilation hole 11 and the second ventilation hole 12 are air inlet holes, the gas entering the first air duct 211 from the first ventilation hole 11 enters the first sub-air port 311 through the other end of the first air duct 211, and then enters the second air outlet 313; the gas entering the second air duct 221 from the second ventilation hole 12 enters the second sub-air port 312 through the other end of the second air duct 221, and then enters the second air outlet 313.

When the first ventilation hole 11 and the second ventilation hole 12 are air outlets, the gas emitted from the second air outlet 313 enters the first sub-air outlet 311 and the second sub-air outlet 312 respectively. The air entering the first sub-air outlet 311 enters the external space through the first air duct 211 and the first ventilation hole 11; the air entering the second sub-air outlet 312 enters the external space through the second air duct 221 and the second ventilation hole 12.

The beneficial effects of the above arrangement are that the fan assembly 03 provides wind-guiding power through the fan 32, and has a simple structure; a closed wind cavity is formed by connecting the fan bracket 31 with the upper shell 21 and the lower shell 22, and no additional air duct mechanism is required, thereby simplifying the structure of the ironing device, reducing parts, and lowering assembly costs and efficiency; the second air outlet 313 is communicated to the first sub-air outlet 311 and the second sub-air outlet 312, so that air can be guided to two air ducts by one fan 32, which can simplify the structure and reduce costs.

In other embodiments, corresponding fans may be separately provided for the first air duct and the second air duct respectively, and the first air duct and the second air duct are not communicated to each other, which can increase the air flow rate of the single air duct and further improve the air outlet or air inlet efficiency of the single air duct.

Optionally, one end of the upper shell 21 adjacent to the fan bracket 31 is arranged in the first sub-air outlet 311 and abuts against the inner wall of the first sub-air outlet 311; one end of the lower shell 22 adjacent to the fan bracket 31 is arranged in the second sub-air outlet 312 and abuts against the inner wall of the second sub-air outlet 312.

Specifically, one end of the upper shell 21 adjacent to the fan bracket 31 is arranged in the first sub-air outlet 311 and abuts against the inner wall of the first sub-air outlet 311, so as to realize the fastening connection between the upper shell 21 and the fan bracket 31, and the air tightness is good, so that the gas can smoothly enter the first sub-air outlet 311 through the first air duct 211, thereby reducing the energy loss of the gas during the flow process; one end of the lower shell 22 adjacent to the fan bracket 31 is arranged in the second sub-air outlet 312 and abuts against the inner wall of the second sub-air outlet 312, so as to realize the fastening connection between the lower shell 22 and the fan bracket 31, and the air tightness is good, so that the gas can smoothly enter the second sub-air outlet 312 through the second air duct 221, thereby reducing the energy loss of the gas during the flow process; further, this fastening connection method is simple to assemble, has a simple and stable structure, does not require redundant parts, and has good fault tolerance, can reduce the dimensional tolerance requirements for parts, can reduce costs, improve equipment efficiency, and improve product reliability.

In other embodiments, only one end of the upper shell 21 adjacent to the fan bracket 31 can be arranged in the first sub-air outlet 311 and abut against the inner wall of the first sub-air outlet 311, and the lower shell 22 and the fan bracket 31 can be fixedly connected by other means (such as screw fastening, silicone sealing, sealant sealing, etc.).

In other embodiments, only one end of the lower shell 22 adjacent to the fan bracket 31 may be arranged in the second sub-air outlet 312 and abut against the inner wall of the second sub-air outlet 312. The upper shell 21 and the fan bracket 31 may be fixedly connected by other means (such as screw fastening, silicone sealing, sealant sealing, etc.).

Optionally, at least one of the connection between the upper shell 21 and the fan bracket 31, the connection between the lower shell 22 and the fan bracket 31, the connection between the upper shell 21 and the ironing board 01, and the connection between the lower shell 22 and the ironing board 01 is connected in a taper fit.

In other embodiments, other methods may be used to fasten the upper shell 21 and the fan bracket 31, the lower shell 22 and the fan bracket 31, the upper shell 21 and the ironing board 01, or the lower shell 22 and the ironing board 01, such as screw fastening, sealing cotton pressing, pasting, etc.

Optionally, the upper shell 21 is formed in one piece, and the lower shell 22 is formed in one piece.

The integrally formed upper shell 21 and lower shell 22 can reduce the difficulty of assembly and facilitate the production and assembly of the product. There is no need to produce additional air duct mechanism components, which can reduce the number of product components and can be directly demolded, thereby improving production efficiency and improving the structural reliability of the product. It can also improve the smoothness of gas flow and reduce the pressure loss along the gas flow process. For example, when the first ventilation hole 11 and the second ventilation hole 12 are set as air inlets, the adsorption effect of the first ventilation hole 11 and the second ventilation hole 12 can be improved during air intake.

In other embodiments, the upper shell 21 and/or lower shell 22 can be disassembled and assembled based on the adjustment of the air duct structure or to improve the convenience of production. For example, the upper shell 21 can be disassembled into a first air duct sealing cover and a sub-shell structure, and the first air duct sealing cover and the sub-shell structure can be sealed by a sealant.

Optionally, the ironing device also comprises a housing 04, which is provided with a linear cavity, and the heating assembly and the fan assembly 03 are arranged in the linear cavity along the axis of the linear cavity. The housing 04 is connected to the ironing board 04, and the inner shell 111 and the outer shell 112 are arranged in the linear cavity.

This arrangement can reduce the degree of adjustment of the air flow direction during the flow process, make the air flow smoother, increase the air flow speed, reduce the energy loss of the air during the flow process, and thus enhance the auxiliary effect of the ventilation holes on the ironing function of the ironing device.

Optionally, the inner wall of the air duct is arranged as a plane wall along the air guiding direction. This arrangement can improve the smoothness of air circulation and reduce flow rate loss.

In another embodiment, the inner wall of the air duct is arranged as a curved wall along the air guiding direction. This arrangement can more smoothly adjust the extension direction of the air duct, reduce the loss during the air circulation process, and reduce the flow rate loss.

Optionally, the housing 04 has air guide openings 41 which are respectively arranged on both side walls of the housing 04 at one end away from the ironing board 01, and the air guide openings 41 communicate the linear cavity with the external space. This arrangement can make the degree of adjustment of the flow direction of the air entering the fan assembly 03 from the air guide openings 41 or the air output from the fan assembly 03 to the air guide openings 41 less during the flow process, so that the air can flow more smoothly, increase the air flow speed, and reduce the energy loss of the air during the flow process.

Optionally, the ventilation holes include strip-shaped openings, which are disposed in a peripheral area of the ironing board 01 and arranged along the circumference of the ironing board 01.

The setting of the strip openings can increase the air guide area of the ventilation holes, thereby improving the air guide efficiency of the ventilation holes. For example, when the ventilation holes are air inlet holes, the adsorption force of the ironing board 01 on clothes can be improved, and the phenomenon of clothes being blown away from the ironing board 01 due to the steam emitted from the steam hole 10 during ironing can be reduced.

Optionally, the first ventilation holes 11 are strip-shaped openings, and/or the second ventilation holes 12 are strip-shaped openings.

The arrangement of the strip openings can increase the air guide area of the first ventilation holes 11 and the second ventilation holes 12, thereby improving the air guide efficiency of the first ventilation holes 11 and the second ventilation holes 12. For example, when the first ventilation holes 11 and the second ventilation holes 12 are air inlet holes, the adsorption force of the ironing board 01 on clothes can be improved, thereby reducing the phenomenon that clothes are blown away from the ironing board 01 due to the steam emitted from the steam hole 10 during ironing.

Optionally, the first ventilation hole 11 and the second ventilation hole 12 are arranged opposite to each other on the ironing board 01 and are respectively located on two sides of the steam hole 10. This arrangement can make the air guiding effect of the first ventilation hole 11 and the second ventilation hole 12 more uniform. For example, when the first ventilation hole 11 and the second ventilation hole 12 are air inlet holes, the adsorption force of the ironing board 01 on the clothes can be more uniform, which can improve the adsorption effect and reduce the phenomenon that the clothes are blown away from the ironing board 01 due to the steam emitted from the steam hole 10 during ironing. Therefore, one-handed ironing can be achieved without pulling the clothes all the time during the ironing process, and the ironing effect and convenience can be improved, thereby improving the user experience.

In other embodiments, the first ventilation hole 11 and the second ventilation hole 12 can be communicated with each other, and the first air duct 211 and the second air duct 221 are also communicated with each other accordingly. For example, the first ventilation hole 11 and the second ventilation hole 12 are communicated with each other and arranged around the ironing board, and the steam hole is located in the middle of the ironing board 01. This arrangement can further increase the air guide area of the first ventilation hole 11 and the second ventilation hole 12, thereby improving the air guide efficiency of the first ventilation hole 11 and the second ventilation hole 12. For example, when the first ventilation hole 11 and the second ventilation hole 12 are air inlet holes, the adsorption force of the ironing board 01 on the clothes can be further improved, and the adsorption force can be made more uniform, thereby further reducing the phenomenon that the clothes are blown away from the ironing board 01 due to the steam emitted from the steam hole 10 during ironing.

Optionally, the ironing board 01 is provided with a plurality of ventilation holes, which are arranged in a peripheral area of the ironing board 01, and the plurality of ventilation holes are arranged along the circumference of the ironing board 01.

This arrangement can further increase the air guide area of the ventilation holes, thereby improving the air guide efficiency of the ventilation holes, and the arrangement of the ventilation holes along the circumference of the ironing board 01 can make the air suction or air discharge of the ironing device more uniform. For example, when the ventilation holes of the product appear as air suction holes, the adsorption force can be made more uniform, thereby further reducing the phenomenon that the clothes are blown away from the ironing board 01 due to the steam emitted by the steam holes 10 during ironing.

Figure 5:
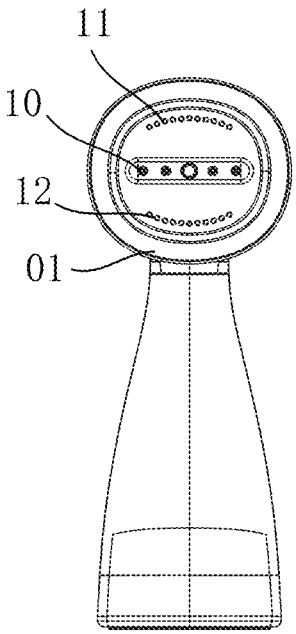
FIG. 5 is a front view of an alternative ironing device according to the embodiment of the present application.
Figure 6:
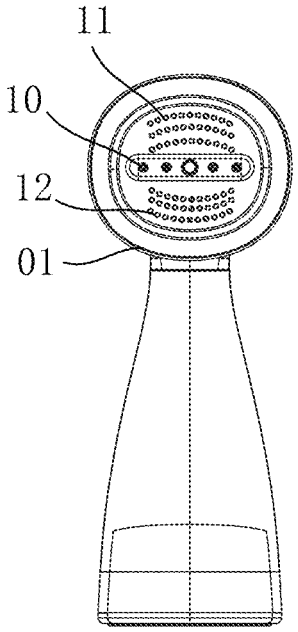
FIG. 6 is a front view of another alternative ironing device according to the embodiment of the present application.

In other embodiments, the first ventilation hole 11 may also be a plurality of openings arranged at intervals, and/or the second ventilation hole 11 may be a plurality of openings arranged at intervals, and the size and shape of the openings are not limited, such as circular, strip or square, etc. The present application does not limit the arrangement of the plurality of openings arranged at intervals of the first ventilation hole 11 or the second ventilation hole 11, for example, as shown in FIG. 5, the plurality of openings may be arranged at intervals along the edge shape of the ironing board 01; for another example, as shown in FIG. 6, the steam hole 10 is located at the center of the ironing board 01, and the plurality of openings may be arranged at intervals along the circumference of the steam hole 10; for another example, the plurality of openings may be arranged at intervals along the edge shape of the ironing board 01 and at intervals along the radial direction of the steam hole 10.

In other embodiments, when the first ventilation hole 11 and the second ventilation hole 12 are air inlet holes, the total area of the first ventilation hole 11 and the second ventilation hole 12 can be set adjacent to the air inlet area of the fan assembly 03 to reduce back pressure, improve the fan's air guiding efficiency, and thereby improve the adsorption effect of the first ventilation hole 11 and the second ventilation hole 12.

Optionally, the ironing device further comprises at least one sealing member, which is arranged on a side of the ironing board 01 adjacent to the heating assembly and coaxially with the ventilation hole, and an end of the sealing member facing away from the ironing board 01 is arranged in the air duct.

Specifically, the end of the seal facing away from the ironing board 01 is arranged in the air duct and coaxially with the ventilation holes, which can improve the air tightness between the ironing board 01 and the inner shell 111 and the outer shell 112, thereby improving the air tightness of the air duct, thereby improving the air guiding effect of the air duct, and thereby improving the effect of the ironing equipment in discharging or sucking air through the ventilation holes.

Optionally, at least one of the connection between the inner housing 111 and the seal, and the connection between the outer housing 112 and the seal is in a tapered fit.

In one application scenario, the inner wall of the inner shell 111 is arranged in abutment with the seal to achieve a tapered fit, and the inner wall of the outer shell 112 is arranged in abutment with the seal to achieve a tapered fit. This arrangement can improve the air tightness between the ironing board 01 and the inner shell 111 and the outer shell 112, thereby improving the air tightness of the air duct, thereby improving the air guiding effect of the air duct, and thereby improving the effect of the ironing equipment in discharging or sucking air through the ventilation holes.

In another application scenario, the inner wall of the inner shell 111 is abutted against the seal to achieve a tapered fit, and the inner wall of the outer shell 112 is airtightly connected to the seal by other means (such as sealant); in another application scenario, the inner wall of the outer shell 112 is abutted against the seal to achieve a tapered fit, and the inner wall of the inner shell 111 is airtightly connected to the seal by other means (such as sealant); no specific limitation is made here.

Optionally, the ironing device also comprises a first sealing member 51 and a second sealing member 52. The first sealing member 51 is arranged on a side of the ironing board 01 adjacent to the heating component and is coaxially arranged with the first ventilation hole 11. An end of the first sealing member 51 facing away from the ironing board 01 is arranged in the first air duct 211. The second sealing member 52 is arranged on a side of the ironing board 01 adjacent to the heating component and is coaxially arranged with the second ventilation hole 12. An end of the second sealing member 52 facing away from the ironing board 01 is arranged in the second air duct 221.

Specifically, one end of the first sealing member 51 facing away from the ironing board 01 is arranged in the first air duct 211 and abuts against the inner wall of the first air duct 211, thereby realizing a sealed connection between the side wall of the first air duct 211 and the ironing board 01, so as to reduce air leakage of the first air duct 211 inside the ironing device; one end of the second sealing member 52 facing away from the ironing board 01 is arranged in the second air duct 221, and abuts against the inner wall of the second air duct 221, thereby realizing a tight connection.

The first sealing member 51 can improve the sealing performance at the connection between the first ventilation hole 11 and the first air duct 211, and the second sealing member 52 can improve the sealing performance at the connection between the second ventilation hole 12 and the second air duct 221, thereby improving the smoothness of air flowing into the first air duct 211 through the first ventilation hole 11 and the smoothness of air flowing into the second air duct 221 through the second ventilation hole 12, and reducing the occurrence of air leakage when air flows into the first air duct 211 through the first ventilation hole 11 and the occurrence of air leakage when gas flows into the second air duct 221 through the second ventilation hole 12; when the first ventilation hole 11 and the second ventilation hole 12 are air outlet holes, the first sealing member 51 can also improve the sealing performance at the connection between the first ventilation hole 11 and the first air duct 211, and the second sealing member 52 can also improve the sealing performance at the connection between the second ventilation hole 12 and the second air duct 221.

Optionally, one end of the first sealing member 51 facing away from the ironing board 01 is disposed in the first air duct 211 and abuts against the tapered inner wall of the first air duct 211 to achieve a tight connection.

This arrangement can further improve the sealing effect, and the taper-fit abutment method is simple to assemble, has a good sealing effect, has good fault tolerance, and can reduce the dimensional tolerance requirements for parts.

Optionally, one end of the second sealing member 52 facing away from the ironing board 01 is arranged in the second air duct 221 and abuts against the tapered inner wall of the second air duct 221 to achieve a tight connection.

This arrangement can further improve the sealing effect, and the taper-fit abutment method is simple to assemble, has a good sealing effect, has good fault tolerance, and can reduce the dimensional tolerance requirements for parts.

In other embodiments, the ironing device comprises only the first sealing member 51, which is disposed on a side of the ironing board 01 adjacent to the heating assembly and coaxially disposed with the first ventilation hole 11, and an end of the first sealing member 51 away from the ironing board 01 is disposed in the first air duct 211. The first sealing member 51 can improve the sealing performance of the connection between the first ventilation hole 11 and the first air duct 211, and the second ventilation hole 12 and the second air duct 221 can be fixedly connected by other means, such as sealant.

In other embodiments, the ironing device only comprises a second sealing member 52, which is arranged on a side of the ironing board 01 adjacent to the heating assembly and coaxially arranged with the second ventilation hole 12, and an end of the second sealing member 52 away from the ironing board 01 is arranged in the second air duct 221. The second sealing member 52 can improve the sealing performance of the connection between the second ventilation hole 12 and the second air duct 52, and the first ventilation hole 11 and the first air duct 211 can be fixedly connected by other means, such as sealant.

In other embodiments, the first sealing member 51 and the second sealing member 52 may be integrally provided, thereby reducing the number of components and improving the convenience of production and assembly.

Optionally, the first sealing member 51 and/or the second sealing member 52 are plastic members with a stable structure, which can improve product reliability.

Optionally, a first silicone seal ring 61 is provided between the first sealing member 51 and the first ventilation hole 11 to improve the sealing between the ironing board 01 and the first sealing member 51, and a second silicone seal ring 62 is provided between the second sealing member 52 and the second ventilation hole 12 to further improve the sealing effect between the first sealing member 51 and the first ventilation hole 11, and between the second sealing member 52 and the second ventilation hole 12. Silicone has excellent resilience, excellent high and low temperature resistance, good physiological stability, and can withstand repeated harsh and disinfection conditions, which can increase the service life of the buffer. In other embodiments, seal rings of other materials can also be selected.

Optionally, a groove is provided on the side of the first sealing member 51 adjacent to the first ventilation hole 11, which can be used to assemble the first silicone sealing ring 61; a groove is provided on the side of the second sealing member 52 adjacent to the second ventilation hole 12, which can be used to assemble the second silicone sealing ring 62. This arrangement can improve structural stability and assembly convenience. In other embodiments, the connection can also be fixed by other methods such as gluing, which is not specifically limited.

Optionally, the first sealing member 51 and the ironing board 01 are fixed by screws, and the second sealing member 52 and the ironing board 01 are fixed by screws. In other embodiments, they may be fixed by other means such as gluing and clamping, which are not specifically limited.

Optionally, the ironing device further comprises a third silicone seal ring 07, which is arranged on the ironing board 01, adjacent to the edge of the ironing board 01, and arranged on the side of the ironing board 01 adjacent to the housing 04. The third silicone seal ring 07 is arranged between the ironing board 01 and the housing 04, and is used to seal the ironing board 01 and the housing 04. This arrangement can further improve the airtightness of the product and is easy to assemble. In other embodiments, seal rings of other materials can also be selected.

Optionally, the steam hole 10 may include a plurality of penetrating holes, or include a strip-shaped penetrating hole, and the size and shape of the steam hole 10 are not specifically limited.

Optionally, the ironing device further comprises a ceramic heat conductive piece 08, which is disposed on a side of the ironing board 01 adjacent to the heating element 20. The ceramic heat conductive piece 08 is provided with a plurality of through holes 801, which are arranged corresponding to the penetrating holes of the steam hole 10, and can increase the temperature of the ironing board 01 near the penetrating holes of the steam hole 10, thereby improving the ironing effect. In other embodiments, other heat conductive layer with heat conductive function can also be used.

Optionally, a snap-on structure may be provided on the ironing board 01 around the steam hole 10 on one side adjacent to the heating element 20 for fixing the ceramic heat conductive piece 08. In other embodiments, the ceramic heat conductive piece 08 may be fixed by other means, such as gluing.

Optionally, the ironing device further comprises a thermostat 09, which is arranged below the heating element 20 to control the heating of the heating element 20.

Optionally, the ironing device further comprises a fourth silicone sealing ring 321, which is disposed between the fan bracket 31 and the fan 32 and is used to seal the fan 32 and the fan bracket 31 to improve the air tightness between the second air outlet 313, the first sub-air outlet 311, and the second sub-air outlet 312.

In other embodiments, sealing rings made of other materials may also be selected.

In one application scenario, the first silicone sealing ring 61 can be assembled into the groove of the first sealing member 51, and the second silicone sealing ring 62 can be assembled into the groove of the second sealing member 52, and then the first sealing member 51 can be fixed to the first ventilation hole 11 on the ironing board 01 by screws, and set on the side of the ironing board 01 adjacent to the heating assembly. At the same time, the second sealing member 52 can be fixed to the second ventilation hole 12 on the ironing board 01 by screws, and set on the side of the ironing board 01 adjacent to the heating assembly further, the third silicone sealing ring 07 and the ceramic heat conductive piece 08 are installed at the corresponding positions of the ironing board 01 to complete the assembly of the ironing board 01; further, the thermostat 09 is arranged below the heating element 20, and then the heating element 20 is installed on the lower shell 22; further, the upper shell 21 is buckled on the lower shell 22, and the heating element 20 and the thermostat 09 are located between the upper shell 21 and the lower shell. The upper shell 21 and the lower shell 22 are tightly connected by screws to complete the assembly of the heating element 20, the inner shell 111 and the outer shell 112 ; further, the fourth silicone sealing ring 321 is installed on the fan 32 and is located on the side of the fan 32 adjacent to the fan bracket 31, and the fan bracket 31 and the fan 32 are further connected and fixed by screws to complete the assembly of the fan assembly 03; further, the assembled ironing board 01 is taperedly matched with the assembled heating element 20, the inner shell 111 and the outer shell 112, and is locked and fixed by screws, and the assembled fan assembly 03 is further taperedly matched and positioned on the side of the heating assembly away from the ironing board 01, and is locked and fixed by screws; finally, the assembled assembly is installed in the linear cavity of the housing 04, and the third silicone sealing ring 07 is abutted against the inner wall of the housing 04 to seal the ironing board 01 and the housing 04, thereby completing the assembly of the ironing device.

In other embodiments, similar improvements may be made to the ironing device, which will not be described in detail here.

Figure 7:
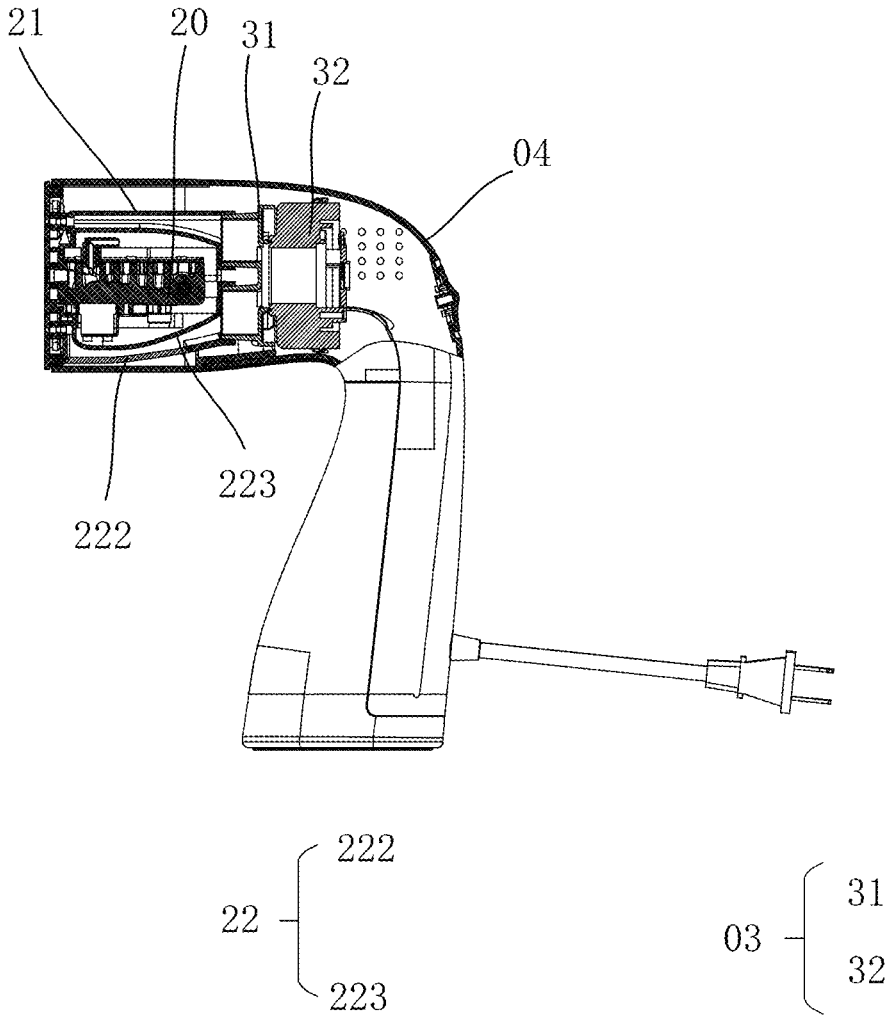
FIG. 7 is a sectional view of another alternative ironing device according to the embodiment of the present application.
Figure 8:
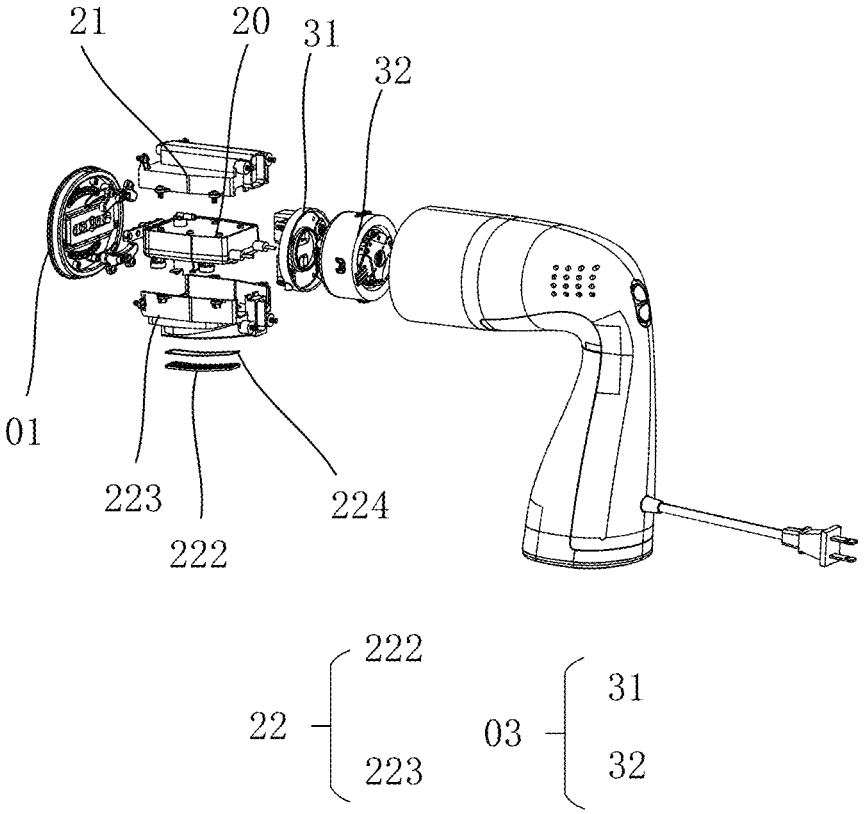
FIG. 8 is an exploded view of the embodiment of FIG. 7.
Figure 9:
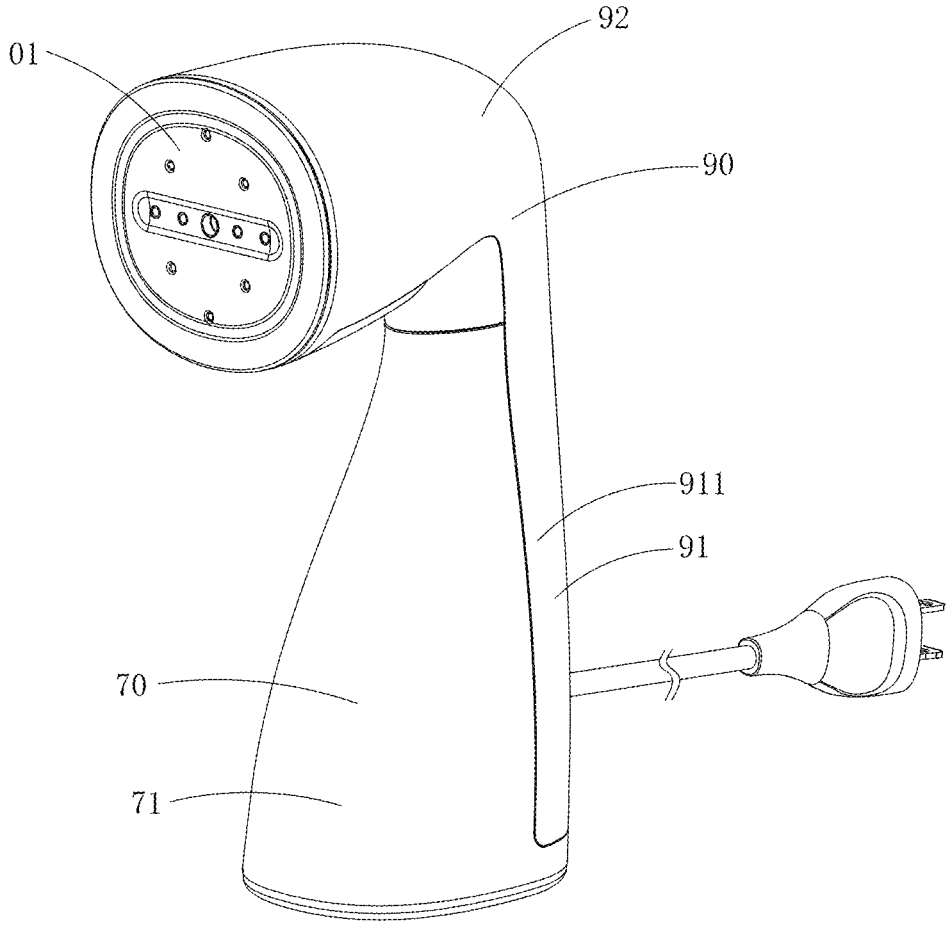
FIG. 9 is a perspective view of an ironing device according an alternative mode of the above embodiment of the present application.
Figure 10:
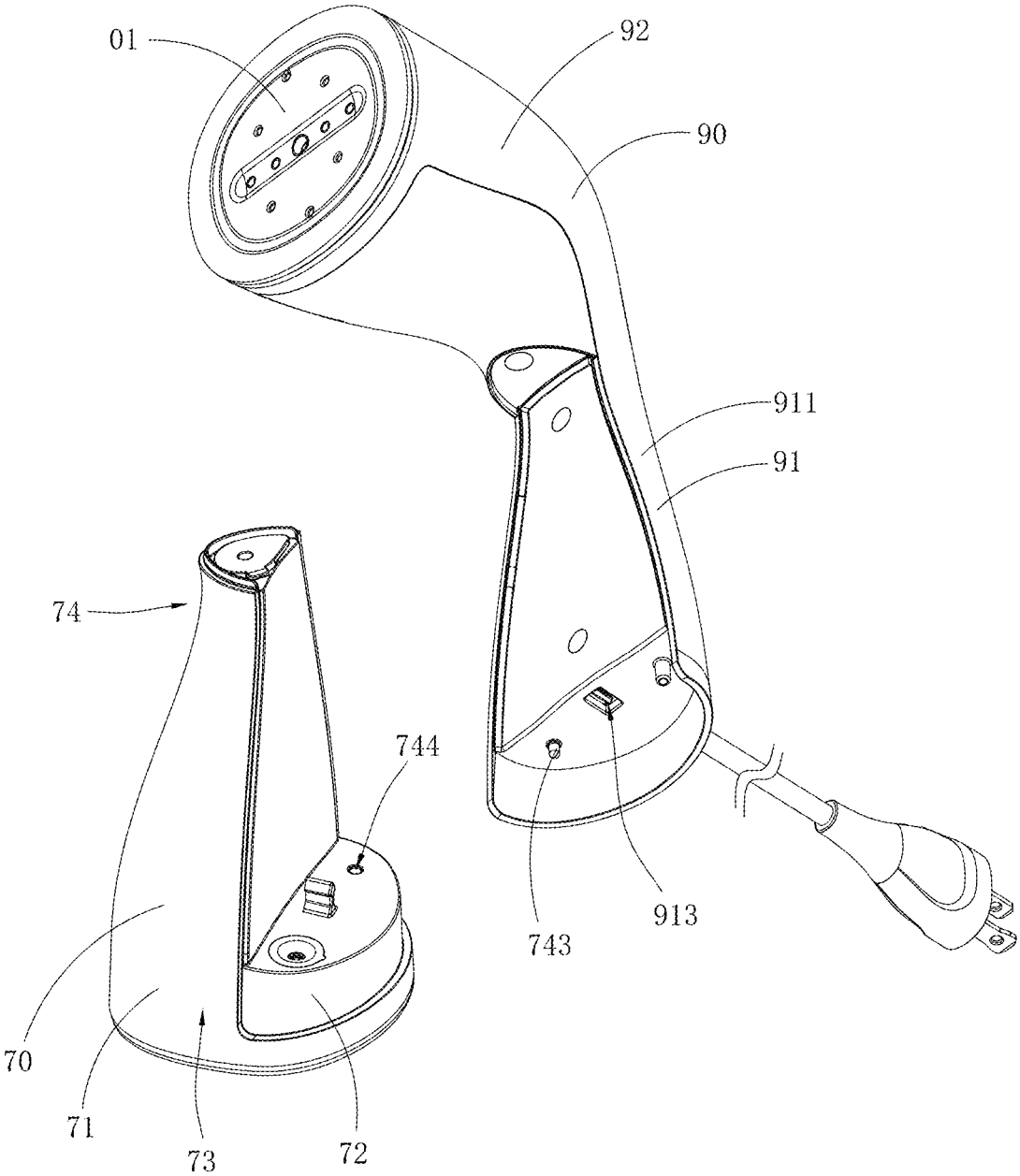
FIG. 10 is an exploded view of the ironing device according the alternative mode of the above embodiment of the present application.
Figure 11:
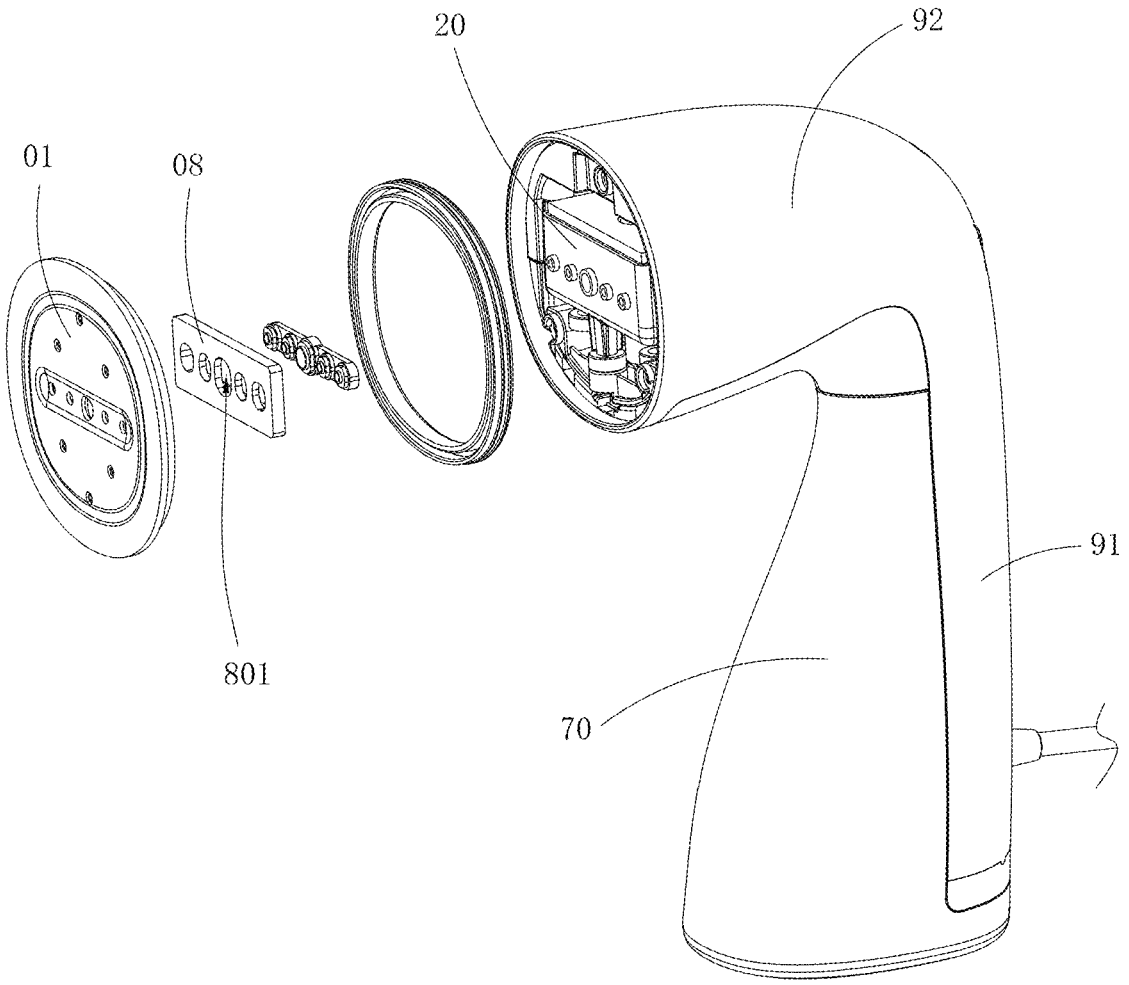
FIG. 11 is another exploded view of the ironing device according the alternative mode of the above embodiment of the present application.
Figure 12:
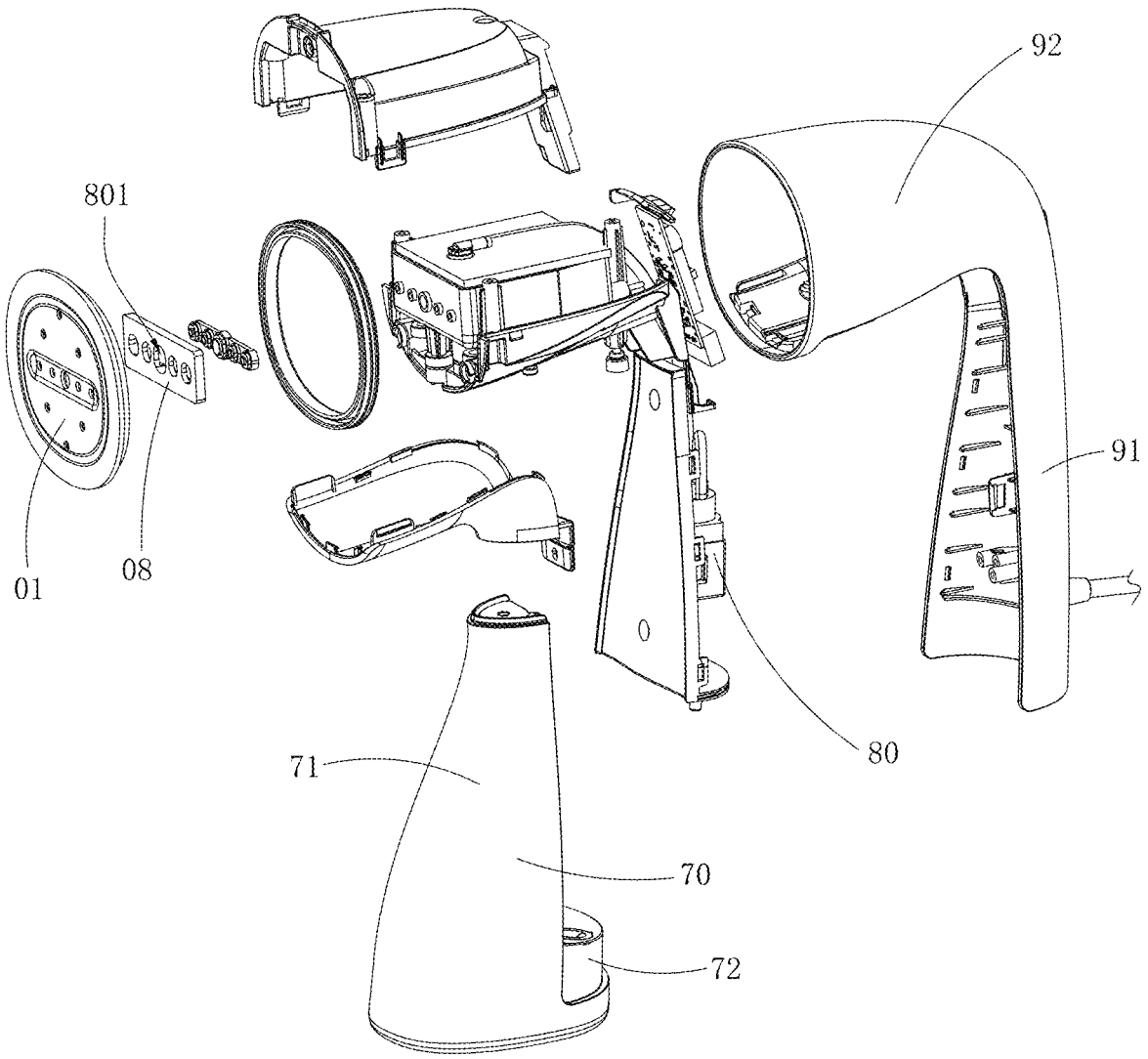
FIG. 12 is a further exploded view of the ironing device according the alternative mode of the above embodiment of the present application.

The present application further proposes an ironing device, as shown in FIGS. 7 and 8, FIG. 7 is a schematic cross-sectional view of another embodiment of the ironing device of the present application; FIG. 8 is an exploded view of the embodiment of FIG. 7. Based on the above embodiment, the difference of this embodiment is that the lower shell 22 includes a first sub-shell 222 and a second sub-shell 223, and the first sub-shell 222 is sealed and connected with the second sub-shell 223 to form a second air duct 221.

In one application scenario, when the heating component is assembled, the first sub-shell 222 is first adhered to the second sub-shell 223 by sealant to complete the assembly of the lower shell 22, and then the subsequent related assembly is performed. For details, please refer to the above embodiment, which will not be repeated here.

lower shell 22 is designed to be a first sub-shell 222 and a second sub-shell 223, which are sealed and connected to form a second air duct 221, which is convenient for production and manufacturing.

Optionally, the first sub-shell 222 and the second sub-shell 223 may be sealed and connected by a shell sealant 224, or may be connected by means of sealant, snap-fit, screws, or the like.

In other embodiments, similar improvements may be made to the ironing device, which will not be described in detail here.

Different from the prior art, the setting of the inner shell 111 can lock the heat of the heating element 20, reduce the risk of heat loss due to heat exchange between the heating element 20 and the wind in the air duct, improve the steam production efficiency of the heating element 20, and at the same time reduce the risk of excessive temperature of the outer shell due to heat radiation of the heating element 20; the inner shell 111 outside the heating element 20 cooperates with the outer shell 121 to form an air duct communicated to the ventilation holes, which can reduce the number of parts of the product, thereby reducing costs, and can form a more unified assembly structure for easy assembly; further, the fan assembly 03 is arranged at one end of the air duct away from the ventilation holes, and according to the different positioning of the product, the ironing device can be targeted to add an air outlet function or an air intake function in addition to the steam ironing function, which can improve the applicability of the ironing device in multiple scenarios, and can assist users in achieving better ironing effects. Therefore, the present application can improve the applicability of the ironing device in multiple scenarios, assist users in achieving better ironing effects, and can reduce the parts of the ironing device, improve the simplicity of the equipment, and reduce costs.

The ironing device further comprises a water tank 70, and the housing 04 comprises a lower part which is detachably coupled with the water tank 100 to form a handle part of the ironing device.

Referring to FIG. 9 to FIG. 15 of the drawings, according to an alternative mode of the above preferred embodiment, the ironing device comprises an ironing board 01, a heat conductive piece 08, a heating element 20, a water tank 70, a pump assembly 80 for supplying water from the water tank 70 to the heating element 20, and a housing 90.

The ironing board 01 has the at least one steam hole 10, the heat conductive piece 08 is arranged between the heating element 20 and the ironing board 01, the heat conductive piece 08 has at least one through hole 801 which is aligned with the steam hole 10.

According to this embodiment, the heat conductive piece 08 is placed between the aluminum alloy ironing board 01 and the heating element 20, so that the heat conductive piece 08 enables heat transfer to warm the aluminum alloy ironing board 01 while also serving as an insulator, ensuring complete isolation between the aluminum alloy ironing board 01 and the heating element 20, eliminating the risk of electrical conduction, and complying with safety regulations.

More specifically, the heat-conductive piece 08 is designed to transfer heat efficiently from the heating element 20 to the aluminum alloy ironing board 01. Ceramic is an excellent heat conductor, which means it ensures fast and even heating across the ironing surface. This uniform heat distribution allows for better ironing performance, reducing the likelihood of hot spots that could damage fabrics or cause uneven results.

The through hole 801 in the heat conductive piece is aligned with the steam hole 10 in the ironing board. This design ensures that steam can pass through without obstruction, enhancing the ironing experience by delivering consistent steam flow to the fabric. The alignment also prevents steam from being trapped or diverted within the structure, improving overall functionality.

One of the most critical advantages of the heat conductive piece 08 is its role as an insulator. The heat conductive piece 08 can be made of ceramic, thermally conductive silicone rubber, thermally conductive epoxy resin, or thermally conductive polymers. Theses materials have excellent electrical insulating properties, completely isolating the aluminum alloy ironing board 01 from the heating element 20. This prevents any risk of electrical conduction to the external panel, eliminating the danger of electric shock during operation and ensuring user safety.

By providing complete electrical isolation between the heating element 20 and the external aluminum alloy ironing board 01, this design ensures the device meets stringent safety regulations. The inclusion of the insulator minimizes hazards related to electrical conduction, which is essential in consumer products involving heat and electricity. This design also reduces the liability risk for manufacturers by addressing potential safety concerns in the product design phase.

In this embodiment, the heat conductive piece 08 can be embodied as a ceramic heat conductive piece. Ceramic materials are known for their high thermal stability, meaning they can withstand the high temperatures generated by the heating element 20 without degrading or warping. The inclusion of the ceramic heat conductive piece 08 helps protect both the heating element 20 and the ironing board 01 from excessive wear, thereby extending the lifespan of the iron. This durability also contributes to maintaining consistent performance over time.

The ceramic piece acts as a thermal buffer, preventing the heating element 20 from directly overheating the aluminum alloy ironing board 01. This reduces the risk of overheating, protecting both the iron and the fabrics being ironed. It provides a layer of control in heat dissipation, ensuring the ironing board reaches and maintains the desired temperature without going beyond safe limits.

With the ceramicheat conductive piece 08 ensuring both uniform heat distribution and safe operation, users benefit from a more reliable and comfortable ironing experience. The risk of electric shock is eliminated, and the even heating reduces the need for repeated passes over the fabric, improving efficiency and reducing ironing time.

The housing 90 comprises a base housing portion 91 and a head housing portion 92 transversely extended from the base housing portion 91, the water tank 70 is detachably coupled to the base housing portion 91 in a side-by-side manner, so as to form a handle part of the handheld garment steamer of the present invention, the rest part connected to the handle part forms a head part.

The side-by-side configuration of the water tank 70 with the base housing portion 91 creates a more ergonomic handle part. The width and shape of the water tank 70 contribute to a comfortable grip. In addition, the positioning of the water tank 70 allows for increased storage capacity while maintaining a compact design, meaning the user can steam longer without needing to refill.

In this embodiment, the integration of the water tank 70 into the handle part ensures a compact, streamlined design, eliminating the need for a separate bulky handle. This keeps the handheld garment steamer light and easy to maneuver. The design of the water tank 70, coupled with the base housing portion 91, provides a sturdy, well-balanced grip. This is especially important for long steaming sessions or when steaming vertically. An upper portion of the water tank 70 is formed with a concave groove 74, so as to be ergonomically conforming to the fingers of the hand of the user which is gripped on the upper portion of the water tank 70.

More specifically, the water tank 70 comprises a tank body 71 and a seat tank portion 72 connected to a lower portion of the tank body 71 to define a water storing cavity 73. A length of the tank body 71 is larger than a length of the seat tank portion 72. The base housing portion 91 of the housing 90 is seated and supported on the seat tank portion 72 when the water tank 70 is assembled with the base housing portion 91 of the housing 11. An upper portion of the tank body 71 cooperated with the base housing portion 91 of the housing 90 for a holding hand of the user to hold thereon.

The water tank 70 and the base housing portion 91 are detachably assembled with each other by a retention unit 74. The retention unit 74 is hidden between the seat tank portion 72 of the water tank 70 and the base housing portion 91, so as to ensure the aesthetic appearance of the outer surface of the handle part 100, and prevent the unwanted touch of the user on the retention unit 74.

The retention unit 74, which can be any suitable detachable assembling means, may comprise magnetically attracting fasteners, snap fasteners, hook-and-eye fasteners, clip fasteners, buckle fasteners or screw fasteners.

Figure 13:
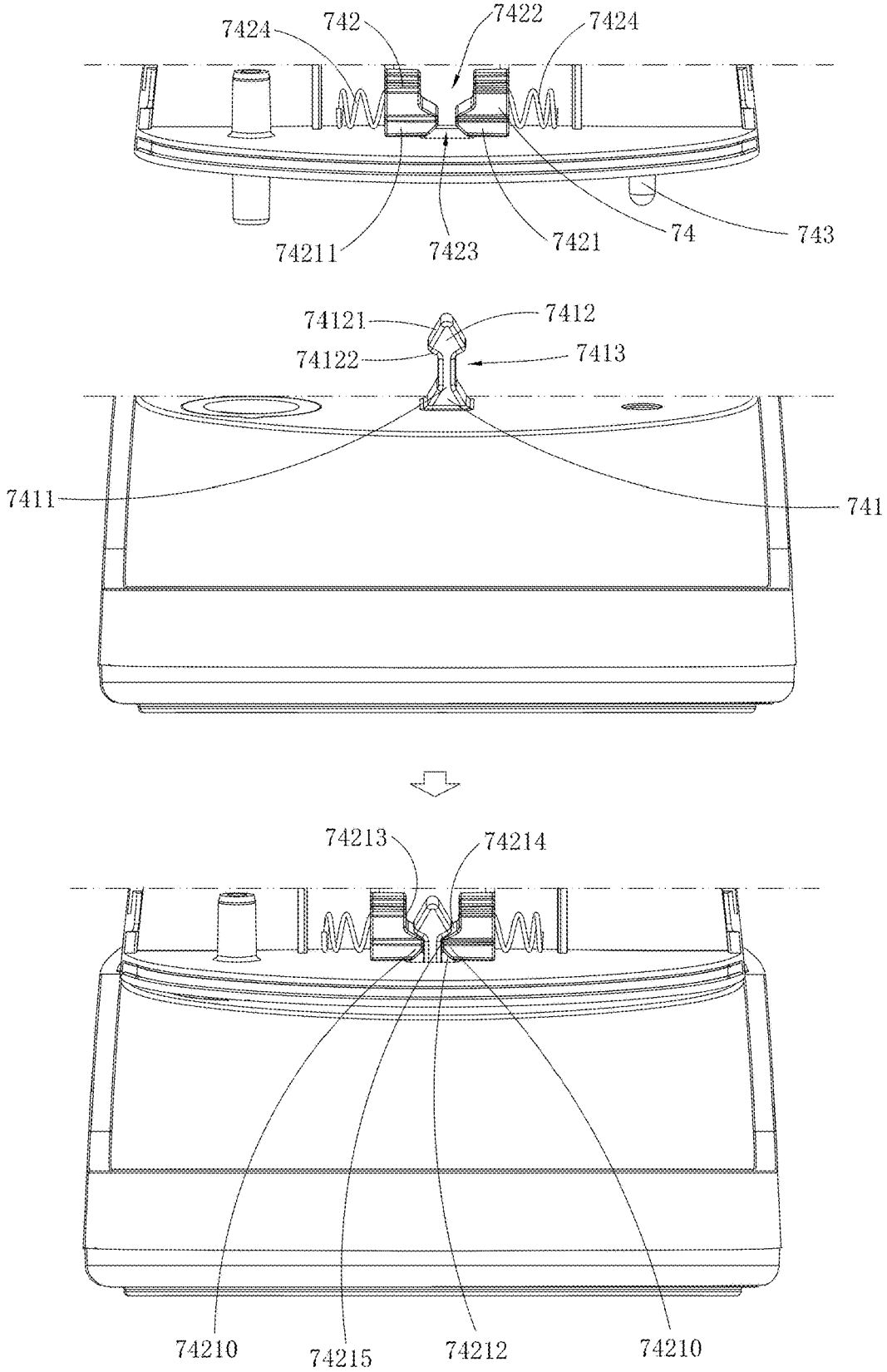
FIG. 13 is a schematic view illustrating the locking unit of the ironing device according the alternative mode of the above embodiment of the present application.

As shown in FIG. 13 of the drawings, the retention unit 74 comprises a retention pin 741 which is protruded from a base top wall of the seat tank portion 72 and a locking mechanism 742 mounted to the base housing portion 91 to retain the retention pin 741 in position when the water tank 70 is assembled with the base housing portion 91.

More specifically, the retention pin 741 comprises a pin body 7411 and an inserting head 7412 which is connected to the pin body 7411, an indented groove 7413 is formed around the pin body 7411 below the inserting head 7412.

A base housing body 911 has an assembling hole 913 formed in the bottom wall for allowing the inserting head 7412 of the retention pin 741 to pass therethrough. The locking mechanism 742 comprises a locking element 7421 defining a locking cavity 7422 with an access opening 7423, and at least one resilient element 7424 connected to the locking element 7421.

Referring to FIG. 13 of the drawings, the inserting head 7412 of the retention pin 741 can be inserted into the locking cavity 7422 through the access opening 7423, so as to be retained in the locking cavity 7422 because of the resilient force of the resilient element 7424 applied to the locking element 7421.

The locking element 7421 comprises two locking members 74211, and two resilient elements 7424 respectively connected to the two locking members 74211, the locking cavity 7422 is defined between the two locking members 74211. When the inserting head 7412 of the retention pin 741 is inserted into the locking cavity 7422, each of the two resilient elements 7424, which can be embodied as a spring, can be compressed, so that the compressed two resilient elements 7424 will securely retain the inserting head 7412 within the locking cavity 7422. A first end of each resilient element 7424 is connected to the corresponding locking member 74211, an opposite second end of each resilient element 7424 can be fixed to a wall of the base housing portion 91.

Each of the two locking members 74211 has a lower inclined guiding surface 74212 and an upper retention surface 74213, the access opening 7423 is defined between the two lower inclined guiding surfaces 74212 and is having gradually width from bottom to top, the locking cavity 7422 is defined between the two upper retention surfaces 74213. The inserting head 7412 comprises two inclined engaging surfaces 74121 each has a diamond shape.

When the water tank 70 is assembled with the base housing portion 91, the inclined engaging surfaces 74121 of the inserting head 7412 of the retention pin 741 are respectively sliding along the two lower inclined guiding surfaces 74212 of the two locking members 74211, so as to force the two locking members 74211 to move apart from each other, so that the inserting head 7412 can be moved into the locking cavity 7422, the two locking members 74211 at two opposite sides of the locking element 7421 will be compressed to allow the two upper retention surface 74213 to biasing against the inserting head 7412, so as to firmly retain the inserting head 7412 in the locking cavity 7422.

Each of the upper retention surface 74213 has a curved surface, and a lower portion of the upper retention surface 74213 is biasing against a lower surface of the inserting head 7412, so as to prevent the inserting head 7412 to escape from the locking cavity 7422.

According to this embodiment, the two resilient elements 7424 are compressed during insertion, allowing them to firmly hold the inserting head 7412 once it is inside the locking cavity 7422. This provides a reliable and secure connection between the water tank 70 and the base housing portion 91.

Each locking member 74211 has the lower inclined guiding surface 74212 that guides the insertion of the retention pin 741. The upper retention surface 74213 holds the inserting head 7412 in place. The gradual widening of the access opening 7423 from bottom to top makes insertion easier while still ensuring a snug fit once fully inserted. The diamond-shaped inclined engaging surfaces 74121 on the inserting head 7412 help guide the inserting head 7412 of the retention pin 741 into the locking cavity 7422, allowing it to smoothly slide along the inclined guiding surfaces 74212.

Once the inserting head 7412 is inside the locking cavity 7422, the upper retention surfaces 74213 press against the inserting head 7412, ensuring it remains securely locked in place. The biasing of the curved upper retention surfaces 74213 against the lower part of the inserting head 7412 prevents any accidental disengagement. The curved design of the upper retention surface 74213 provides additional security. It ensures that the inserting head 7412 is not only firmly held but also prevents any unintentional upward movement, which could cause the inserting head 7412 retention pin to escape from the locking cavity 7422.

The locking unit 74 ensures that the water tank 70 and the base housing portion 91 are tightly connected, reducing the risk of separation during operation. This is especially important for the handheld garment steamer, where stability and secure assembly are critical for safe use.

In this embodiment, each locking member 74211 comprises a protrusion 74210 which has the lower inclined guiding surface 74212, an upper curved abutting surface 74214 for abutting a lower surface 74122 of the inserting head 7412 and a biasing surface 74215 for extending into the indented groove 7413 to bias against an outer surface of the pin body 7411. By engaging with the indented groove 7413, the biasing surface 74215 prevents any displacement of the pin body 7411, further ensuring that the water tank 70 and base housing portion 91 remain securely connected during operation.

While the mechanism securely holds the water tank 70 to the base housing portion 91, it is designed to be easily detachable when needed. The resilience of the springs allows for quick and hassle-free disassembly. More specifically, when the user apply a force of the water tank 70 or the base housing portion 91, the inserting head 7412 is moved downward with respect to the base housing portion 91, so that the downward moving inserting head 7412 will force the resilient elements 7424 to be further compressed, so as to allow the two locking members 74211 to move apart, so that the inserting head 7412 can be moved out from the locking cavity 7422. Once the the inserting head 7412 is detached from the locking cavity 7422 and the access opening 7423, the restoring of the two resilient elements 7424 will restore the original positions of the two locking members 74211.

Alternatively, the inserting head 7412 also can be formed as an inserting ball which can be retained in the locking cavity 7422. The ball-shaped inserting head 7412 provides a more evenly distributed contact area within the locking cavity 7422. This ensures that the retention force applied by the locking members 74211 and resilient elements 7424 is uniformly spread, improving overall stability when the water tank 70 and base housing portion 91 are assembled. The spherical design offers less opportunity for the inserting ball to shift or become misaligned within the locking cavity 7422 which can securely hold the ball in place, reducing the risk of accidental disengagement during use.

Figure 14:
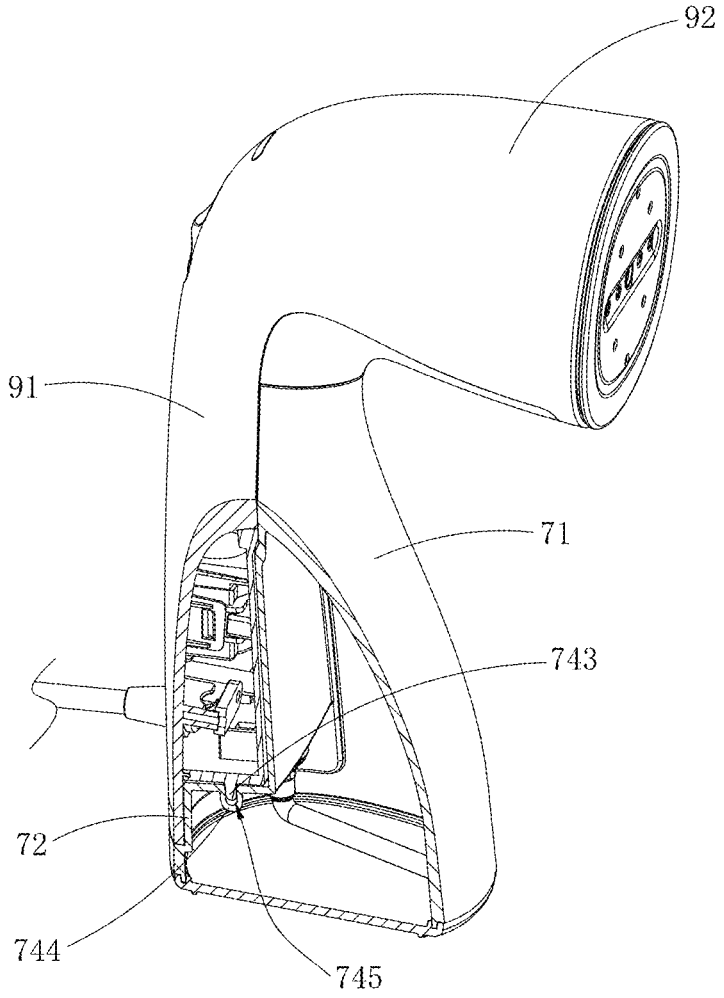
FIG. 14 is another schematic view illustrating the locking unit of the ironing device according the alternative mode of the above embodiment of the present application.
Figure 15:
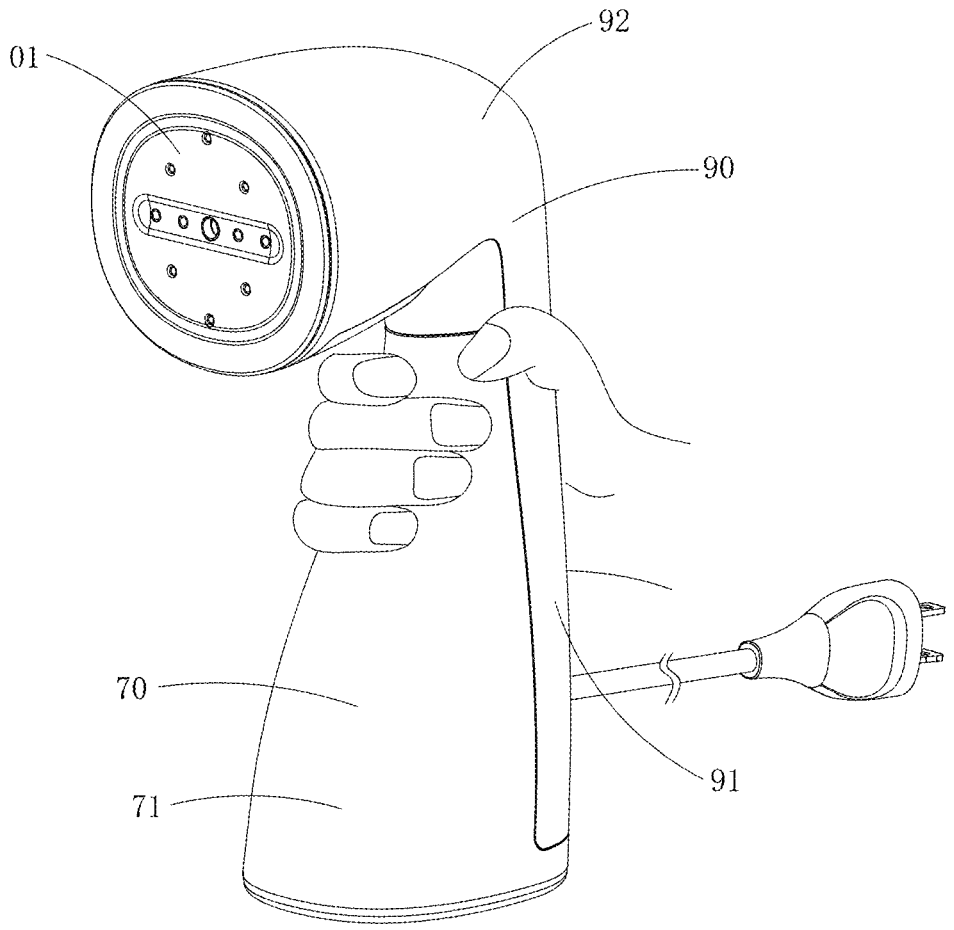
FIG. 15 is a schematic view illustrating the water tank and the base housing portion of the ironing device being gripped by a hand of the user according the alternative mode of the above embodiment of the present application.
Figure 16:
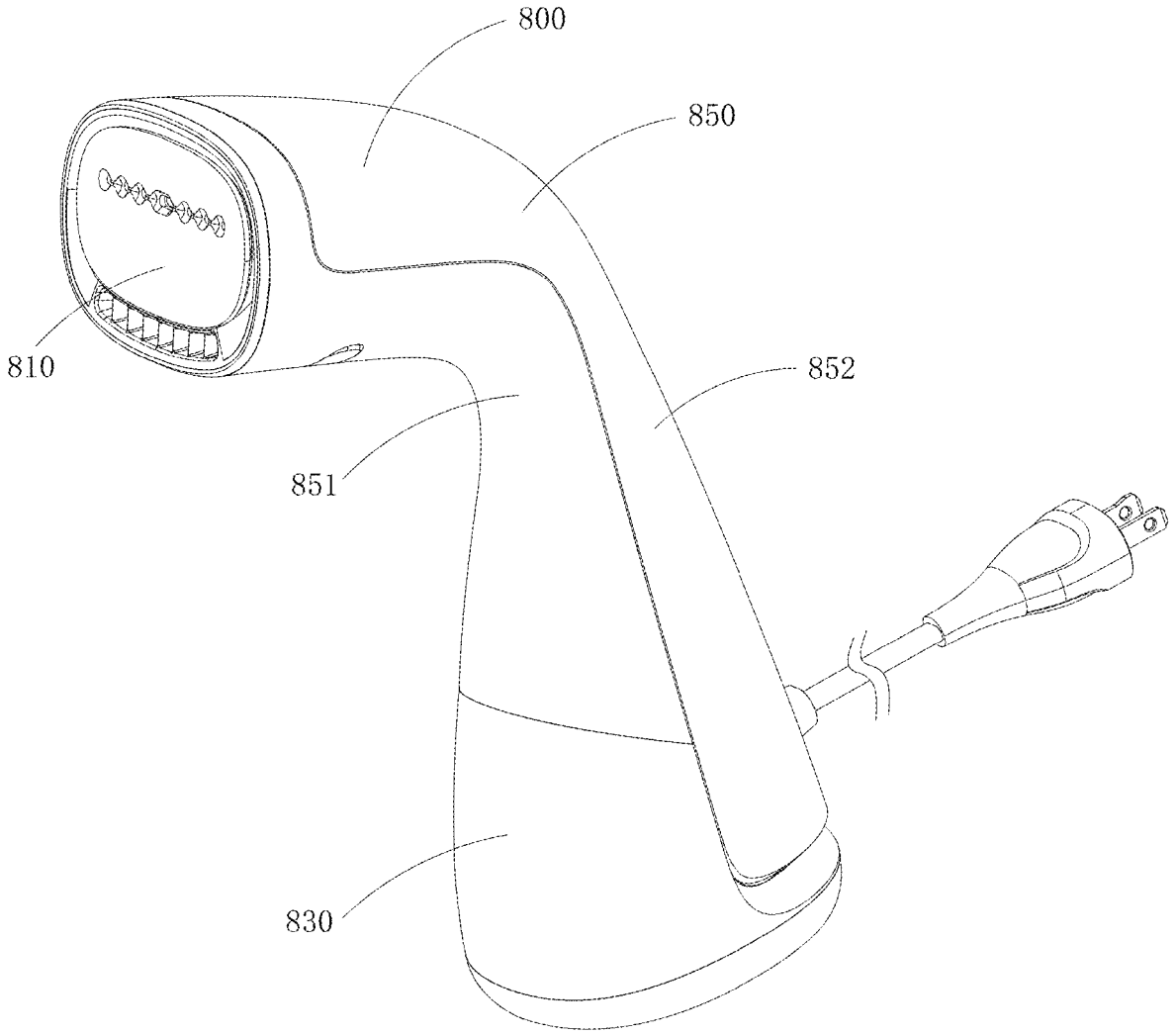
FIG. 16 is a perspective view of an ironing device according to another preferred embodiment of the present application.
Figure 17:
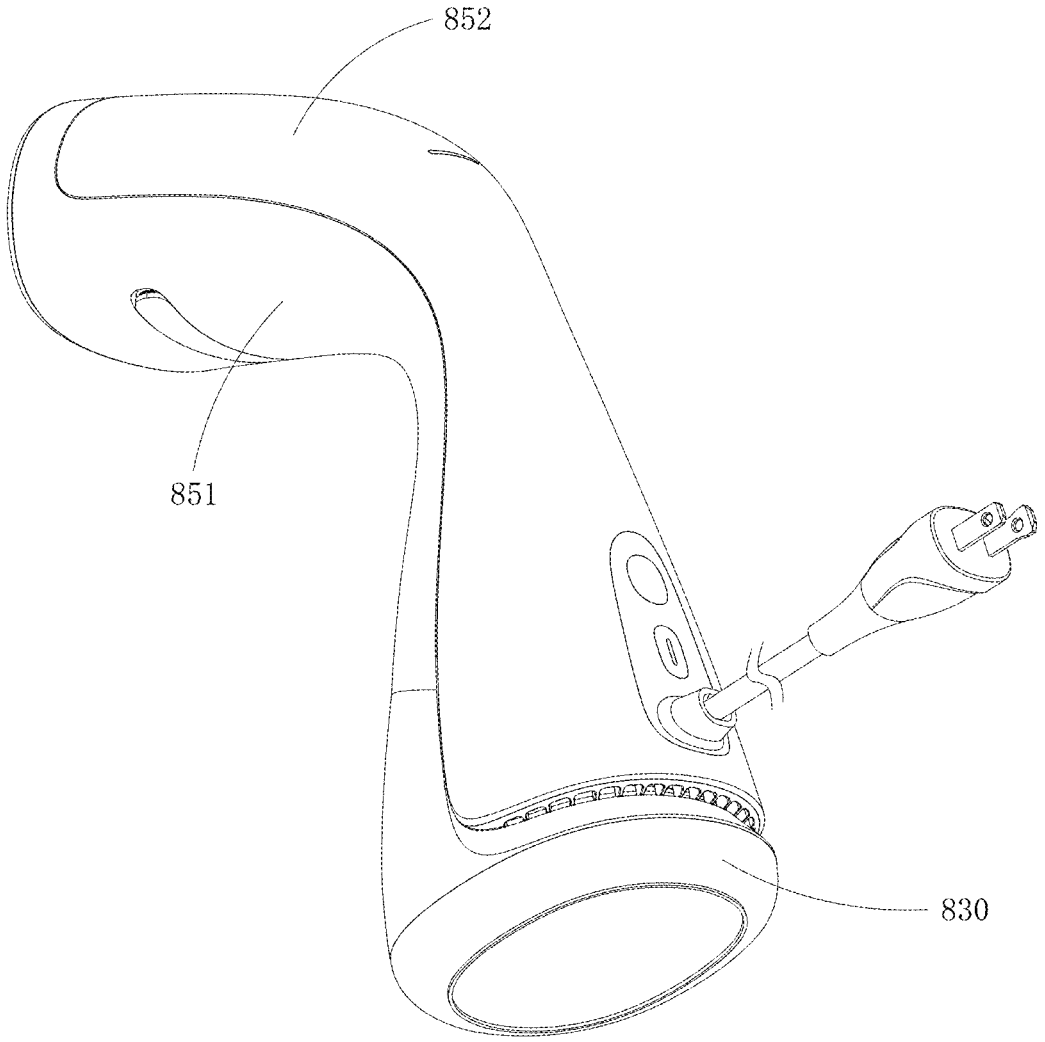
FIG. 17 is an another perspective view of the ironing device according to the above preferred embodiment of the present application.

As shown in FIG. 14, the locking unit 74 further comprises a mounting pin 743 which is protruded from the bottom bottom of the base housing portion 91, and a mounting base 744 is formed on the top wall of the seat tank portion and extending into the inner cavity of the seat tank portion 72. Accordingly, the mounting base 744 has a mounting hole 745 which can be engaged with the mounting pin 743 when the water tank 70 is assembled with the base housing portion 91. The mounting base 744 is extended into the inner cavity of the seat tank portion 72, so that the the depth of the mounting hole 745 is ensured for retaining the mounting pin 743 in position while the top wall seat tank portion 72 is allowed to have a relatively small thickness. Reducing the thickness of the top wall of the seat tank portion 72 while maintaining sufficient engagement depth for the mounting pin 743, results in a lighter handheld ironing device with a larger water storing volume of the inner cavity of the seat tank portion 72.

Referring to FIG. 16 to FIG. 36 of the drawings, according to another preferred embodiment, an ironing device 800 comprises an ironing head 810, an evaporation assembly 820, a water tank 830, a pump assembly 840 for supplying water from the water tank 830 to the evaporation assembly 820, a housing 850 and an air suction assembly 860.

As shown in FIGS. 16 to 20, the housing 850 comprises a first housing portion 851 and a second housing portion 852 coupled to the first housing portion 851, the water tank 830 is detachably coupled to a bottom of the first housing portion 851 and the second housing portion 852, so as to form a handle portion of the ironing device 800 of the present invention.

Figure 18:
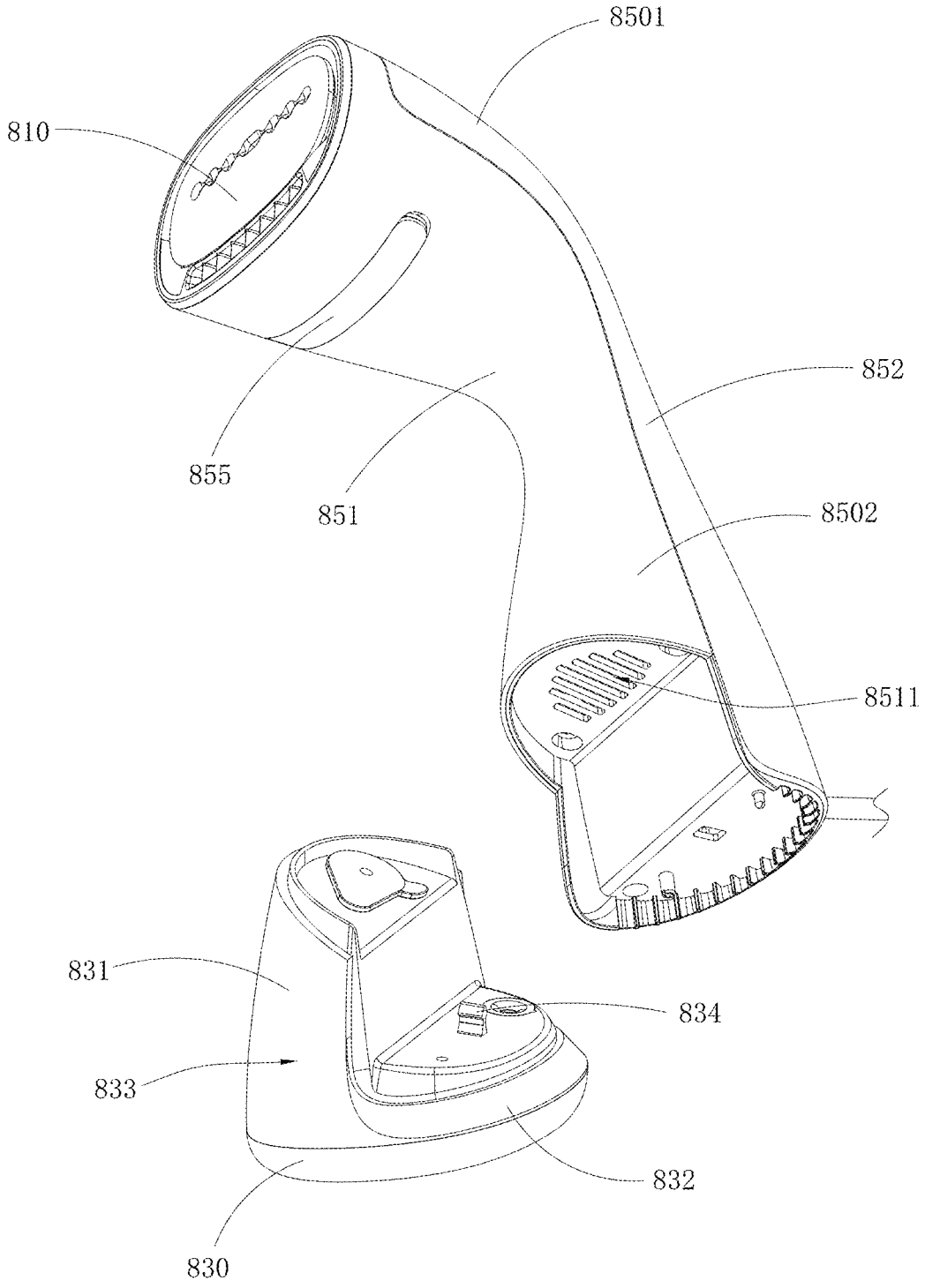
FIG. 18 is an exploded view of the ironing device according to the above preferred embodiment of the present application, wherein a water tank is detached from a housing fo the ironing device.
Figure 19:
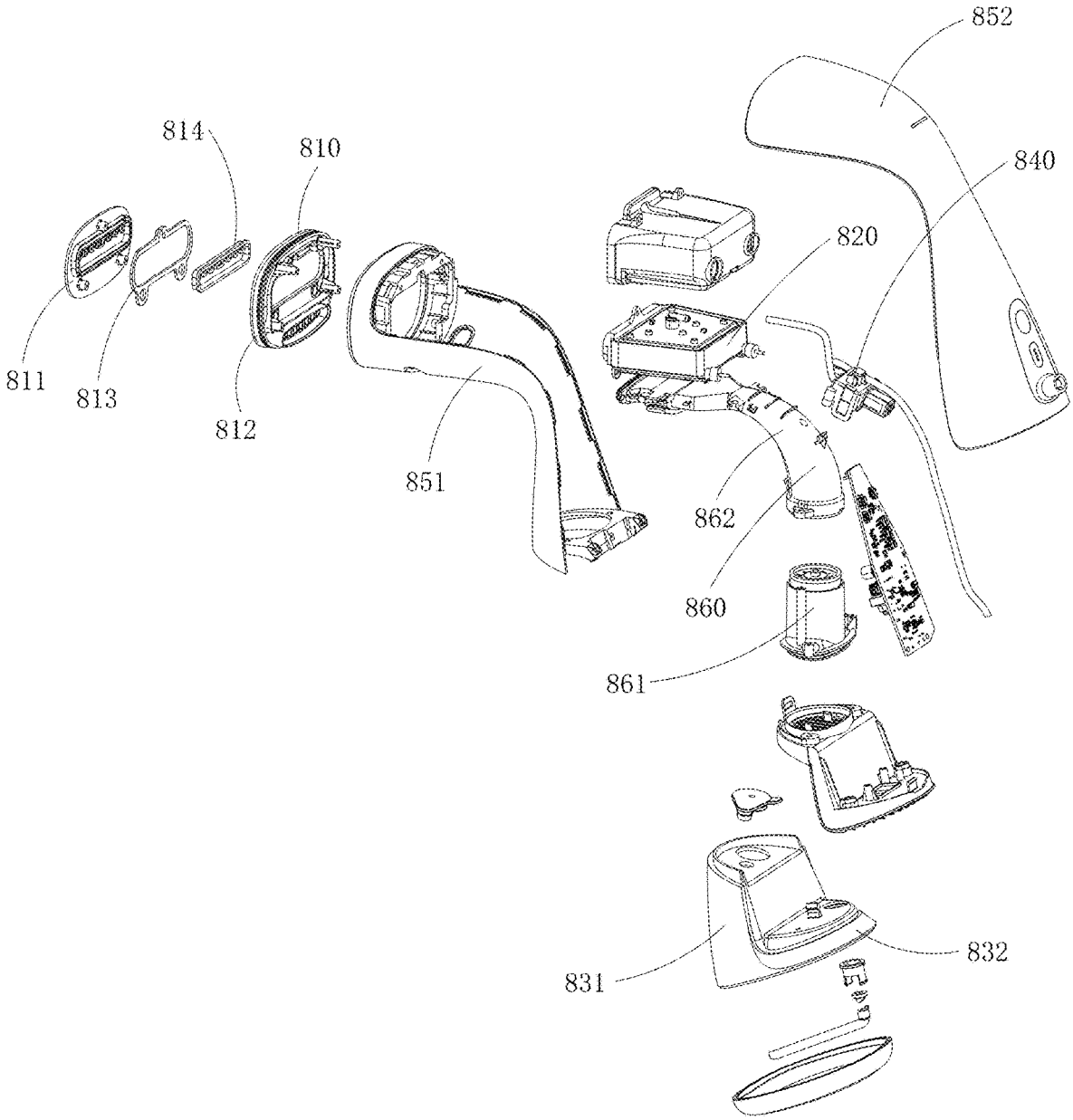
FIG. 19 is a further exploded view of the ironing device according to the above preferred embodiment of the present application.
Figure 20:
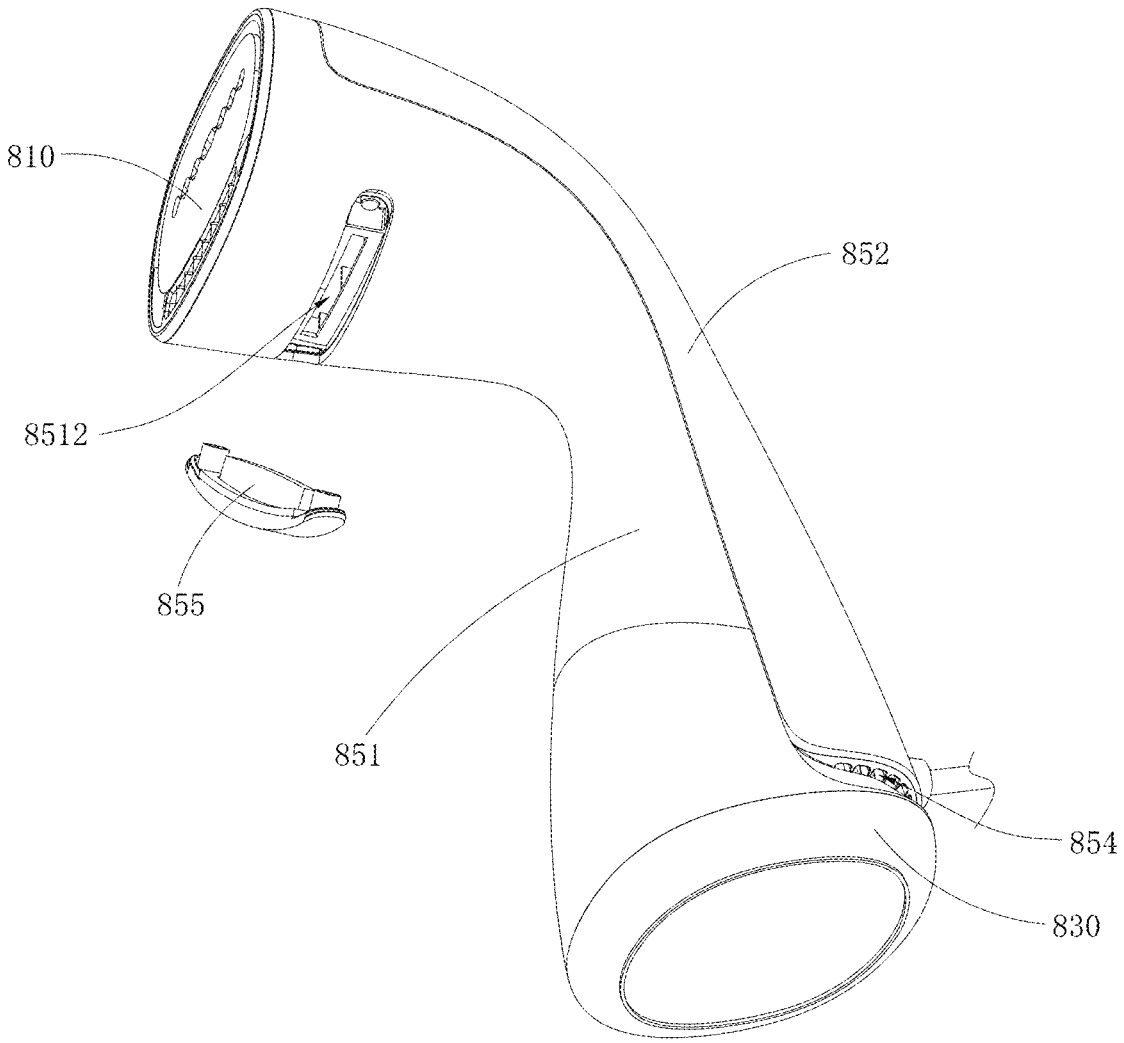
FIG. 20 is a schematic view illustrating a filter element being detached from the housing of the ironing device according to the above preferred embodiment of the present application.
Figure 21:
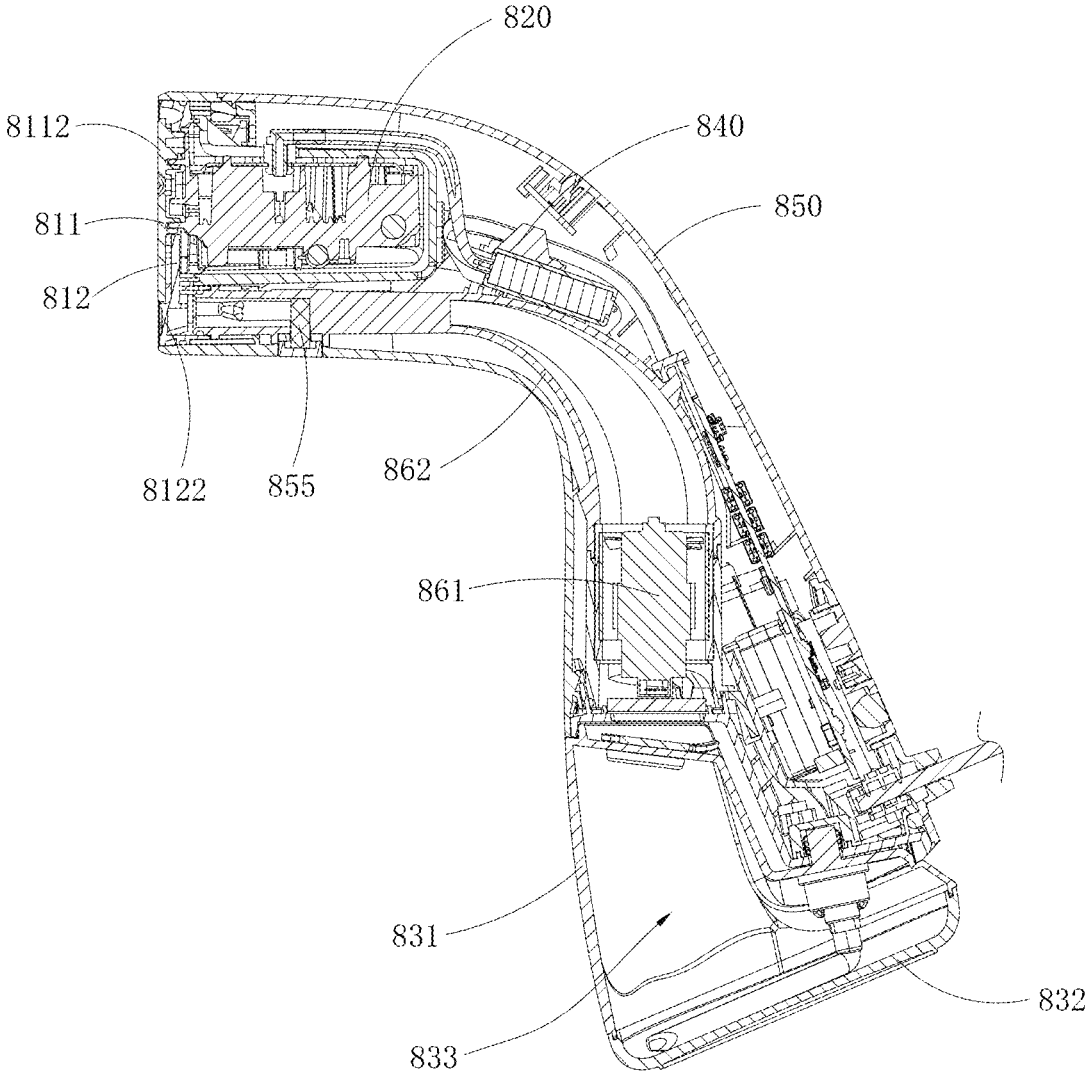
FIG. 21 is a sectional view of the housing of the ironing device according to the above preferred embodiment of the present application.
Figure 22:
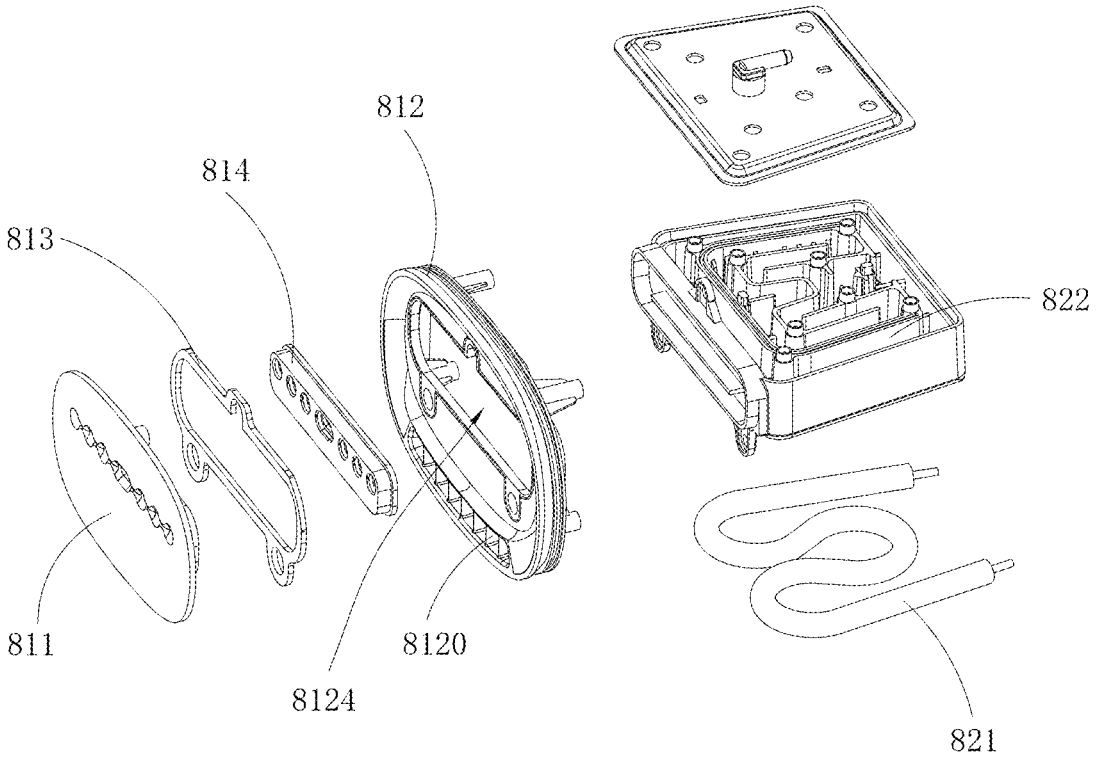
FIG. 22 is an exploded view of an ironing head and an evaporation assembly of the ironing device according to the above preferred embodiment of the present application.
Figure 23:
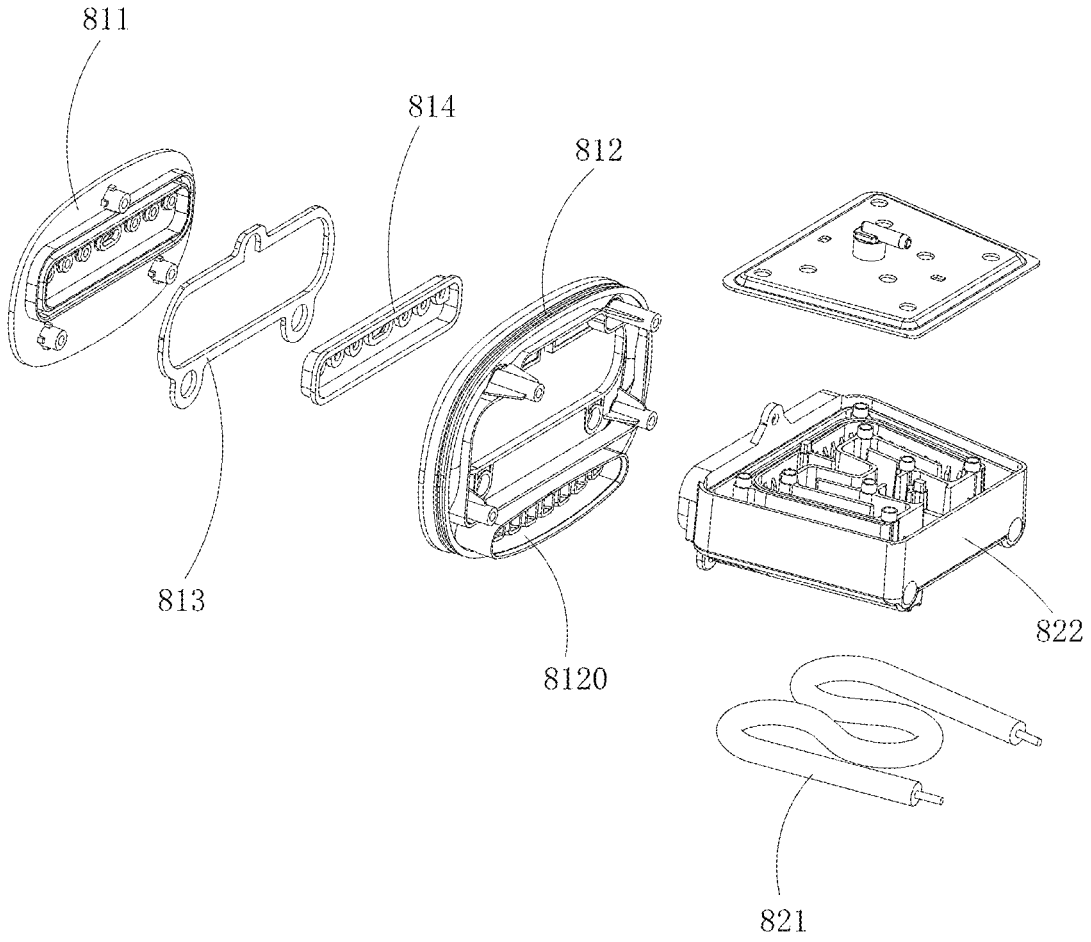
FIG. 23 is another exploded view of the ironing head and the evaporation assembly of the ironing device according to the above preferred embodiment of the present application.
Figure 24:
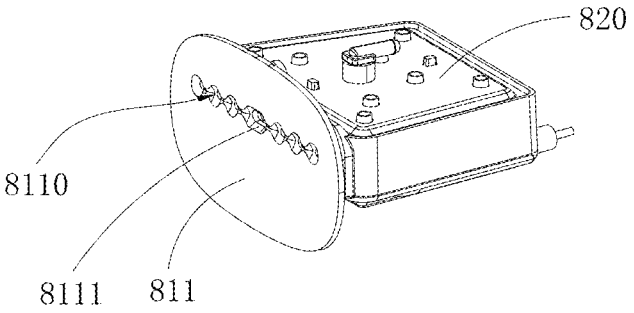
FIG. 24 is a schematic view illustrating an ironing board and the evaporation assembly of the ironing device according to the above preferred embodiment of the present application.
Figure 25:
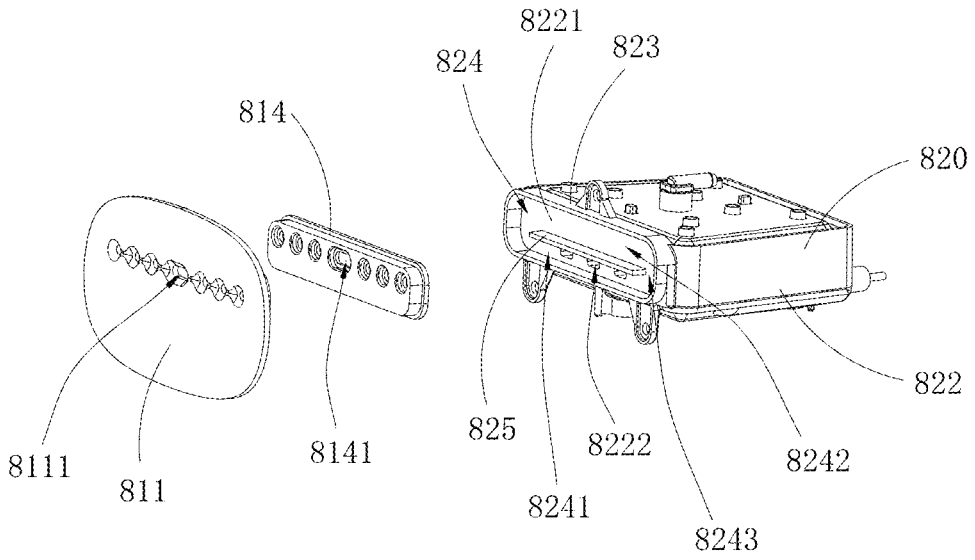
FIG. 25 is an exploded view illustrating the ironing board, the head cover, and the evaporation assembly of the ironing device according to the above preferred embodiment of the present application.

More specifically, as shown in FIGS. 18-19 and 21, the water tank 830 comprises a tank body 831 and a seat tank portion 832 connected to a lower portion of the tank body 831 to define a water storing cavity 833. A length of the tank body 831 is larger than a length of the seat tank portion 832. The first housing portion 851 of the housing 850 is seated and supported on the tank body 831 while the second housing 852 is seated and supported on the seat tank portion 832 when the water tank 830 is assembled with housing 850.

The water tank 830 and the second housing portion 852 are detachably assembled with each other by a retention unit 834. The retention unit 844 is hidden between the seat tank portion 832 of the water tank 830 and the second housing portion 852, so as to ensure the aesthetic appearance of the outer surface of the handle part of the ironing device, and prevent the unwanted touch of the user on the retention unit 834. The pump assembly 840 comprise a water pump which can be a AC pump or a DC pump. In this embodiment, the water pump can be a DC pump which is more compact and easier to design in terms of electrical control.

The retention unit 834, which can be any suitable detachable assembling means, may comprise magnetically attracting fasteners, snap fasteners, hook-and-eye fasteners, clip fasteners, buckle fasteners or screw fasteners.

As shown in FIGS. 22 to 36, the ironing head 810 comprises an ironing board 811 having one or more steam holes 8111 forming a steam area 8110, and a head cover 812 having air suction area 8120 for air suction driven by the air suction assembly 860 which comprises an air suction fan 861, and a sealing ring 813 which is a flexible ring positioned between the ironing board 811 and the head cover 812. The sealing ring 813 is arranged to mount the ironing board 811 to the head cover 812 and enhance the airtightness between the ironing board 811 and the head cover 812.

Figure 26:
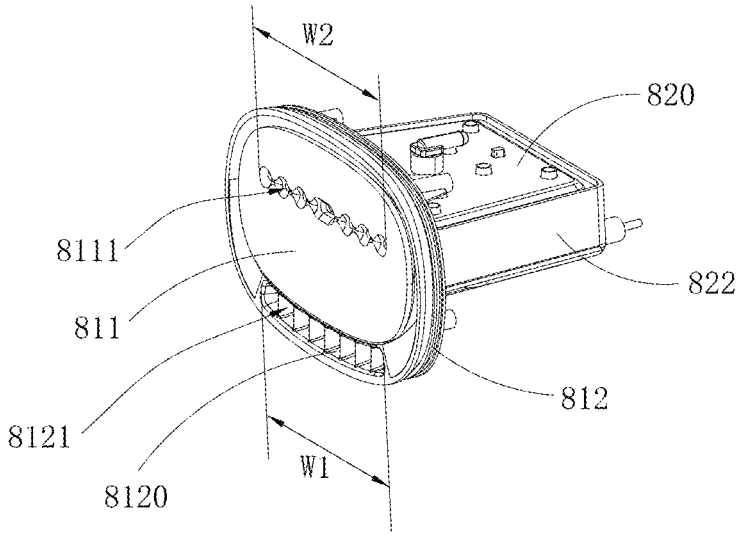
FIG. 26 is a schematic view illustrating the ironing board being assembled with the head cover of the ironing device according to the above preferred embodiment of the present application.
Figure 27:
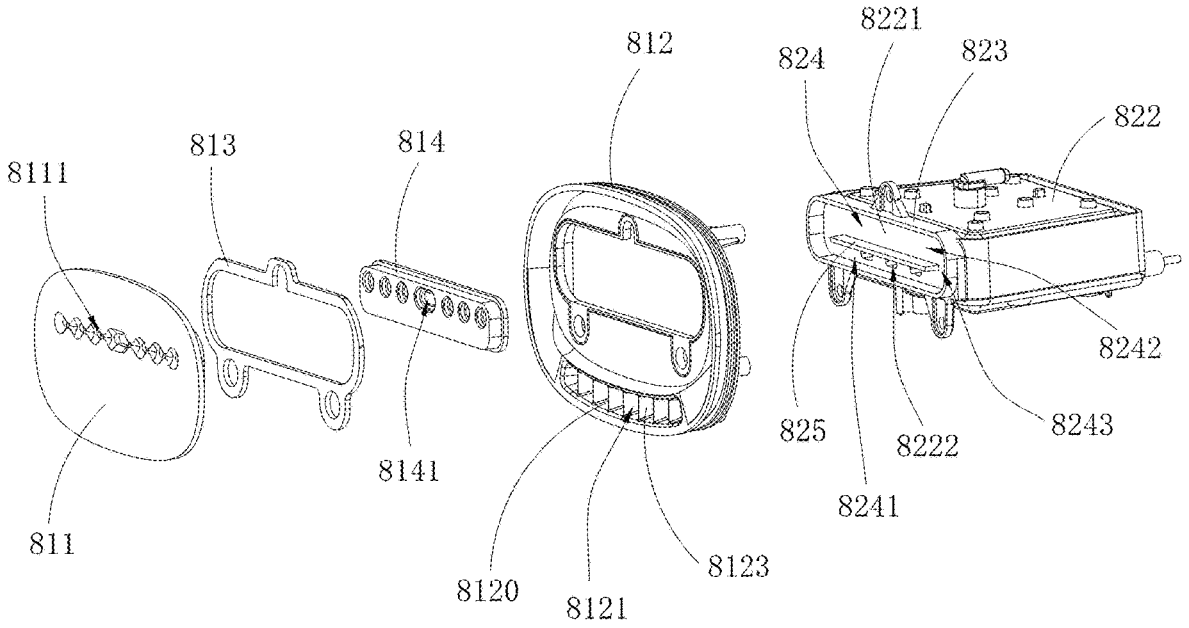
FIG. 27 is an exploded view illustrating the ironing board, the head cover, a chamber cover and the evaporation assembly of the ironing device according to the above preferred embodiment of the present application.
Figure 28:
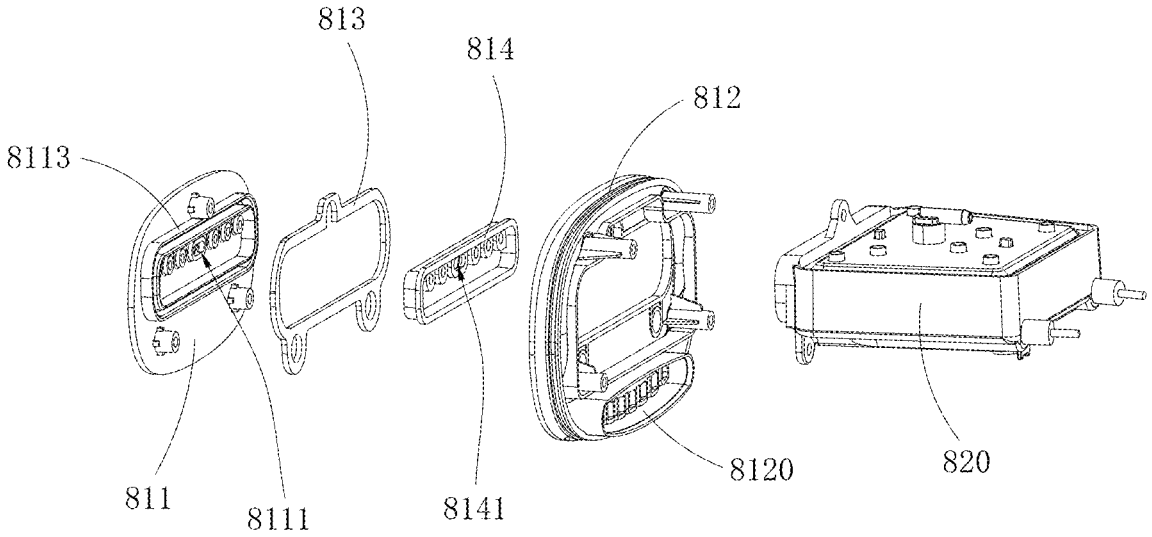
FIG. 28 is another exploded view illustrating the ironing board, the head cover, a chamber cover and the evaporation assembly of the ironing device according to the above preferred embodiment of the present application.
Figure 34:
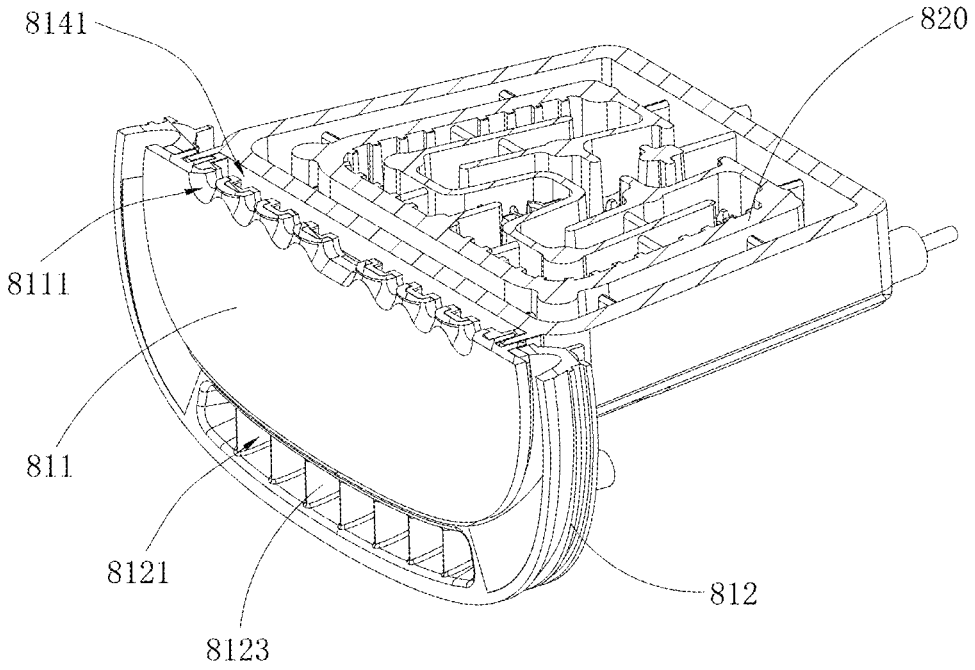

In this embodiment, a plurality of steam holes 8111 is arranged in a row along a width of the ironing board 8111, the air suction area 8120 may be formed by a plurality of air suction holes 8121 which are arranged in a row along a width of the head cover 812 and is positioned below the row of the steam holes 8111. As shown in FIGS. 26-27 and 34, a plurality of partition ridges 8123 is spacedly arranged in the air suction area 8120 which is an elongated inlet area to form the plurality of air suction holes 8121.

According to the instant invention, no air suction inlets are formed above the steam holes 8111. Based on the typical usage habits of the ironing device, it is generally operated from top to bottom along the fabric. By adopting a rational design that separates the steam holes 8111 and the air suction holes 8121 into an upper-lower arrangement, the fabric first passes through the air suction holes 8121 before reaching the steam holes 8111. This effectively prevents high-temperature steam from being drawn into the ironing device through the air suction holes 8121, eliminating the risk of steam burns at the air suction holes 8121 while also allowing for unrestricted steam temperature and output.

Since the fabric is first adsorbed before being ironed, there is no risk of disrupting the smoothness of the fabric or soiling the garment after ironing. This eliminates the need to weaken the suction power, ensuring strong adsorption without compromising ironing performance.

Accordingly, the aligned row arrangement of the steam holes 8111 and suction holes 8121 ensures that fabric is first secured before being subjected to high-temperature steam. This improves steam penetration and heat transfer, leading to more effective wrinkle removal.

The positioning of the air suction holes 8121 below the steam holes 8111 prevents excessive steam dispersion and helps concentrate heat and moisture on the target fabric area, optimizing ironing results. This separation also minimizes the risk of hot steam being expelled near the user's face, significantly improving safety and comfort during use.

With the introduction of the air suction holes 8121 and the air suction assembly 860, the suction mechanism creates a firm adhesion between the fabric and the ironing board, preventing fabric shifting during ironing. This ensures even steam distribution and eliminates inconsistent pressing or unintended creases that could occur if the fabric moved.

In addition, the suction function also helps remove excess moisture from the fabric after steaming, reducing water accumulation and the risk of damp spots or dripping, which is a common issue in conventional steam irons. This feature also helps fabric dry faster after ironing, preventing prolonged dampness that could cause unwanted odors or mildew.

Some fabrics are highly susceptible to wrinkling due to external forces, and the adsorption function may cause such fabrics to crease. To address this issue, as shown in FIG. 26, the width W1 of an air suction area 8120 formed by the air suction holes 8121 is specifically designed to be slightly narrower than the width W2 of a steam area 8110 formed by the steam holes 8111. This ensures that most of the surfaces around the steam holes 8111 remain in full contact with the fabric for effective ironing while also ensuring that fabric passing through the air suction holes 8121 is subsequently ironed by the steam holes 8111.

When given a fixed fan suction power, a larger adsorption area results in weaker suction. Accordingly, the elongated flattened design of the air suction area 8120 of the present invention is able to help reduce suction loss caused by an overly large adsorption area. Preferably, a width of each air suction hole 8121 is smaller than a height of the corresponding air suction hole 8121.

Figure 31:
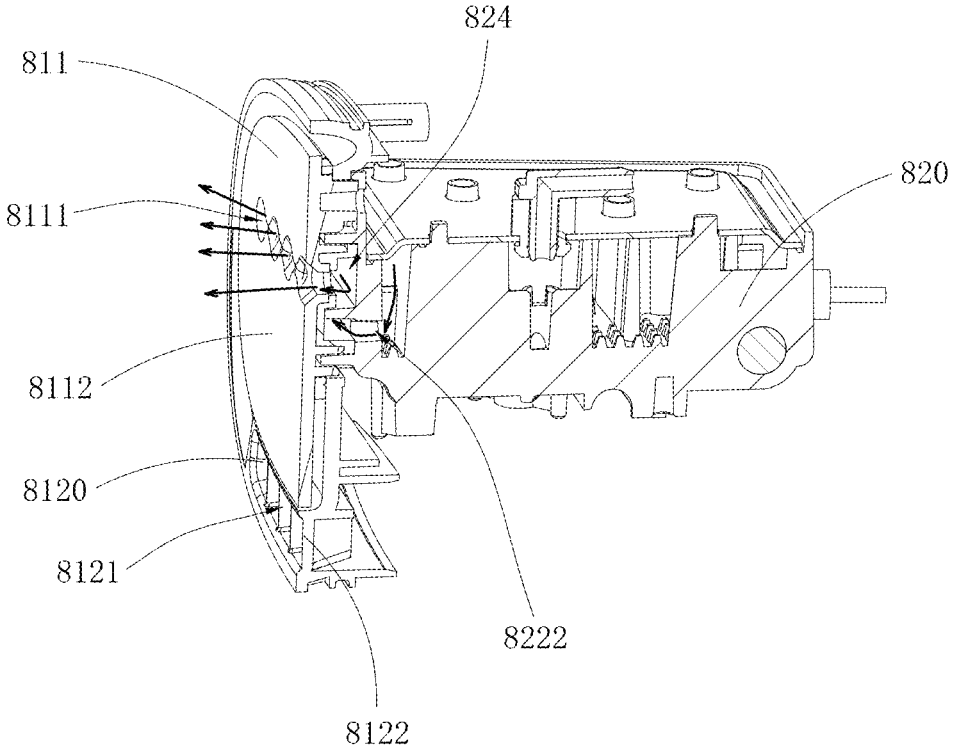
FIG. 31 is another schematic view illustrating the steam path of the ironing device according to the above preferred embodiment of the present application.
Figure 32:
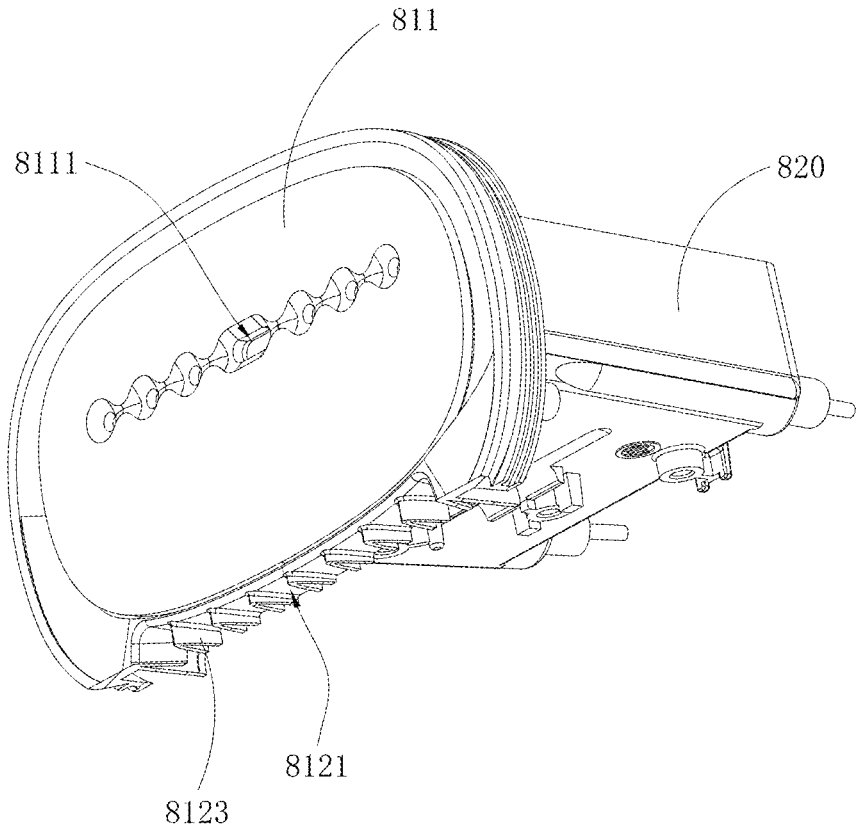
FIG. 32 is a schematic view illustrating the air suction area and the steam area of the ironing device according to the above preferred embodiment of the present application.
Figure 33:
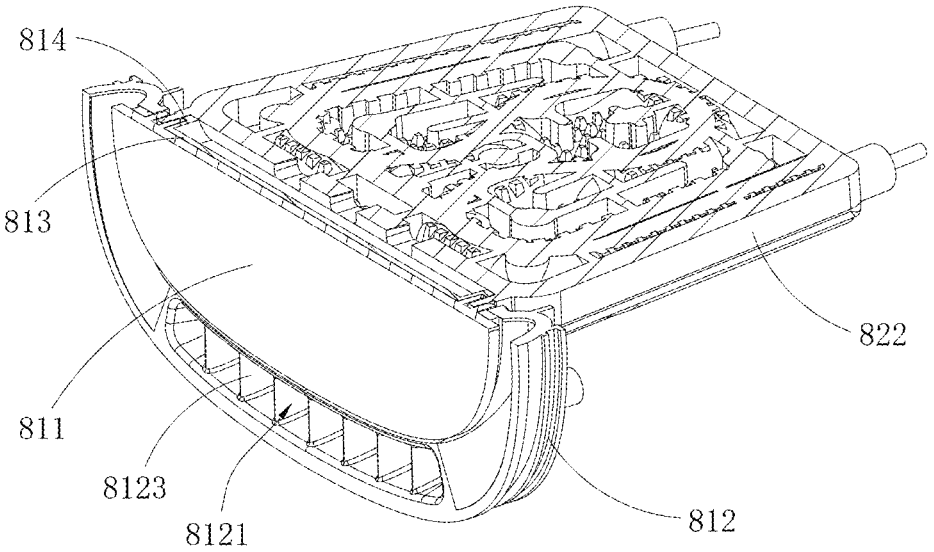
FIG. 33 and FIG. 34 are schematic views illustrating the ironing board, the chamber cover, the head cover and the casing of the evaporation assembly of the ironing device according to the above preferred embodiment of the present application.

As shown in FIGS. 21 and 31 of the drawings, a surface plane 8122 of the air suction area 8120 is slightly backward than a surface plane 8112 of the ironing board 811. This design ensures that when the air suction holes 8121 adhere tightly to the fabric, the fabric is pressed more firmly against the ironing board 811, so as to enhance the ironing effect.

Figure 35:
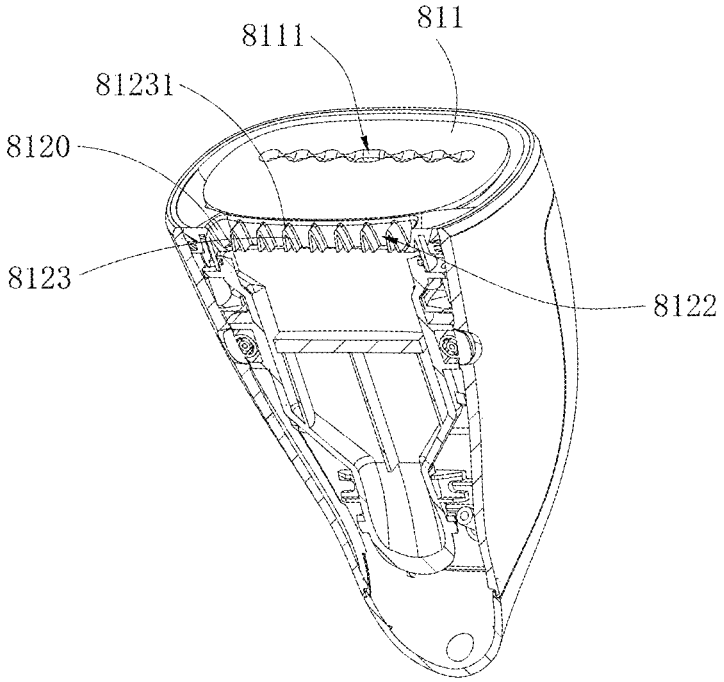
FIG. 35 is a schematic views illustrating a plurality of partition ridges in the air suction area of the ironing device according to the above preferred embodiment of the present application.

During use, the adsorption function may draw in larger debris. To prevent such debris from entering the machine without significantly affecting suction performance, the plurality of partition ridges 8123 are added to the air suction area 8120. Referring to FIG. 35 of the drawings, each air suction hole 8121 is preferred to have a gradually reducing width along the direction toward the evaporation assembly 820. An end 81231 of each of the partition ridge 8123 away from the evaporation assembly 820 is positioned backward and inward from the surface plane 8122 of the air suction area 8120, and both the partition ridge 8123 and the surfaces forming the air suction hole 8121 are made smooth and curved, so that this feature prevents the adsorption process from creating noticeable wrinkles in the fabric. In this embodiment, each partition ridge 8123 has a V-shape configuration and has a gradually increasing width toward the evaporation assembly 820 away from the ironing board 811.

In this embodiment, the air suction fan 861 of the air suction assembly 860 is disposed in the first housing portion 851 at a position adjacent to the water tank 830. The air suction assembly 860 further comprises an air suction duct 862 coupled between the air suction area 8120 of the head cover 812 and the air suction fan 861 to guide the air flow from the air suction holes 8121 toward the air suction fan 861.

As shown in FIG. 18 of the drawings, one or more outlet holes 8511 is formed at a bottom of the first housing portion 851 which is detachably coupled to the tank body 831, an air guiding passage 853 is formed between the bottom of the housing 850 and the top of the water tank 830, and one or more air discharge holes 854 is formed between the top of the seat tank portion 832 and the bottom of the second housing portion 852, so that air drawn in the housing 850 by the air suction fan 861 will be guided into the air guiding passage 853 between the housing 850 and the water tank 830 through the outlet holes 8511 and released through the air discharge holes 854 formed at a lower portion of the handle part of the ironing device.

Figure 36:
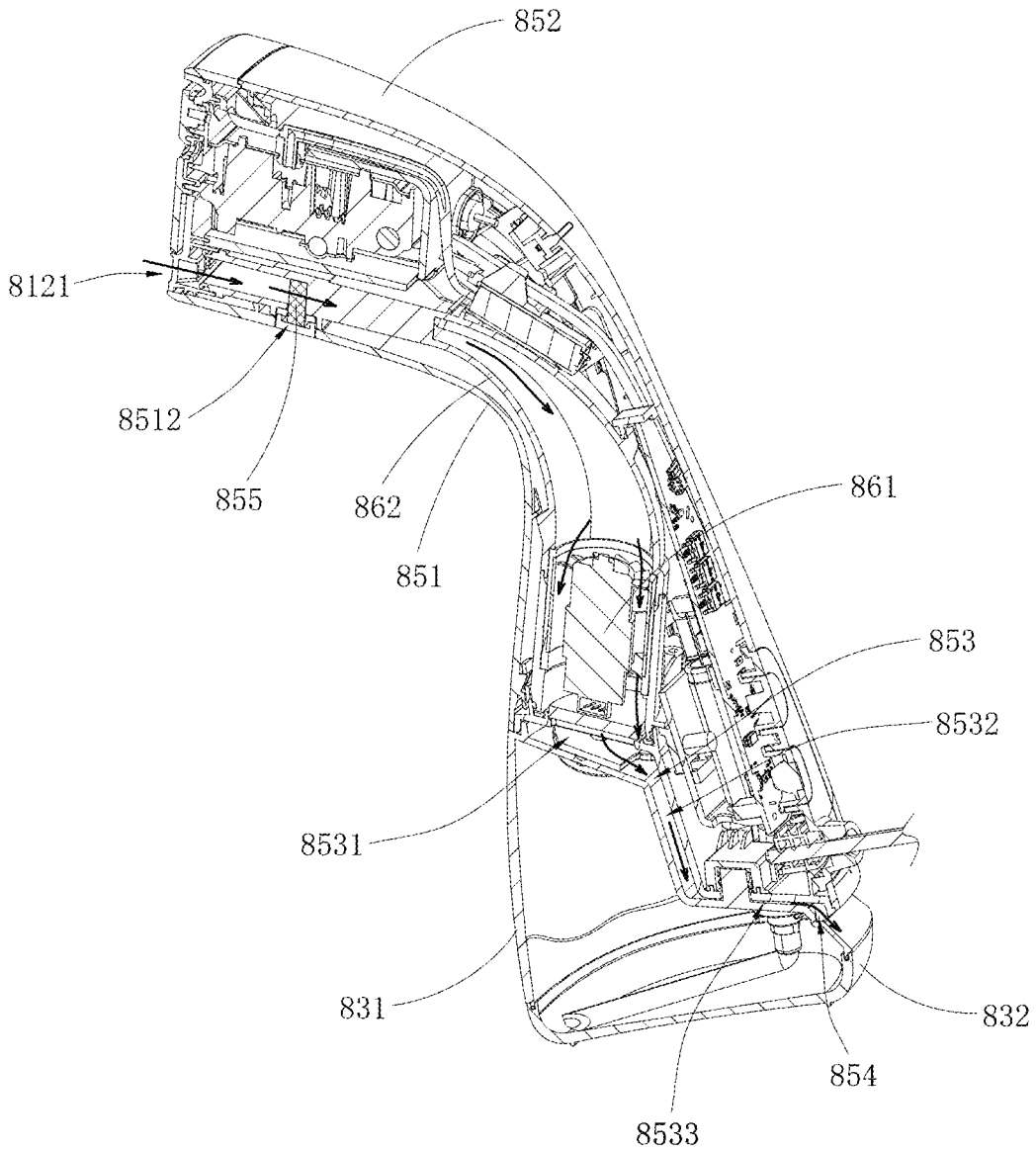
FIG. 36 is a sectional illustrating an air suction path of the ironing device according to the above preferred embodiment of the present application.

As shown in FIG. 36, the air guiding passage 853 includes a first gap 8531 between the bottom of the first housing portion 851 and the top of the tank body 831, a second gap 8532 between the inner side wall of the tank body 831 and the side wall of the second housing portion 852, and a third gap 8533 between the bottom of the second housing portion 852 and the top of the seat tank portion 832.

The air suction fan 861 is positioned near the water tank 830, which is typically located in the lower portion of the ironing device. This placement increases the distance between the fan and the user's ears, significantly reducing perceived noise levels during operation.

In this embodiment, the housing 850 comprises a head part 8501 and a handle part 8502 transversely extended from the head part 8501 for the user to hold thereon, the ironing head 810 and the evaporation assembly 820 are mounted to the head part 8501, the water tank 830 and the air suction fan 861 are mounted to the handle part 8502, as shown in FIG. 18 and FIG. 36.

Many ironing devices generate high-pitched noise due to fan operation, which can be unpleasant at close proximity. By relocating the fan away from the user's head, the design minimizes direct noise exposure, enhancing user comfort.

Instead of allowing noise to resonate inside the device, this design guides airflow and noise out of the ironing device through a designated air releasing path. This controlled noise discharge helps to dissipate sound energy, preventing unnecessary noise buildup within the housing and ensuring a quieter overall operation.

More specifically, instead of allowing air to be expelled directly from the air suction fan 861, which would generate significant noise, the design channels the airflow through a structured internal ducting system. The air discharge holes 854 are positioned above the water tank 830, allowing the water tank 830 to act as a noise-dampening barrier, reducing the intensity of sound waves traveling outward. The air then moves through the gap between the water tank 830 and the housing 850, undergoing multiple directional changes before reaching the air discharge holes 854. This multi-stage airflow guidance system helps dissipate noise energy and prevents a sudden burst of air from causing loud operational sounds.

The air discharge holes 854 are located at the lower portion of the ironing device, directing airflow away from the user's face. This placement prevents hot steam from being drawn in and expelled near the user, reducing the risk of discomfort or accidental burns. Direct exposure to strong airflow that may cause discomfort to the user is also prevented.

In this embodiment, a plurality of the air discharge holes 854 are formed along the periphery of the seat tank portion 832, so as to efficiently direct the air in the air guiding passage 853 to discharge out of the ironing device.

During operation, the air suction function inevitably draws in dust, lint, and small debris from fabrics. If these contaminants enter the motor, they may accumulate over time, leading to reduced suction efficiency, increased wear on the motor components, and a shortened device lifespan. To prevent such issues, a removable filter element 855 such as a sponge is installed within the airflow pathway between the air suction area 8120 and the air suction fan 861.

Without a filtration mechanism, dust buildup can gradually clog the internal air pathways, reducing the device's suction power. By incorporating the cleanable filter element 855, the user can periodically remove and wash the filter sponge, ensuring that the suction function remains consistently effective over long-term use. This maintains optimal air circulation and prevents any progressive decline in performance.

The first housing portion 851 has a bottom mounting groove 8512, the removable filter element 855 is detachably coupled to the bottom mounting groove 8512 and assembled to the air guiding passage 853 to act as a protective barrier, safeguarding the internal components from damage and extending the overall lifespan of the ironing device.

The evaporation assembly 820 comprises a heating element 821, a casing 822 for receiving the heating element 821 to generate steam by evaporating the water pumped into the casing 822 by the pump assembly 840, a surrounding wall 823 extended from a front side of the casing 822. The casing 822 has an outlet wall 8221 having one or more steam outlet holes 8222 at a lower portion thereof, the surrounding wall 823 is extended from a periphery of the outlet wall 8221. The ironing head 810 further comprises a chamber cover 814 which is coupled with the surrounding wall 823 to define a heating chamber 824 for heating the ironing board 811. Accordingly, the steam generated in the evaporation assembly 820 will enter the heating chamber 824 through the steam outlet holes 8222, and the ironing board 8111 covered on the chamber cover 814 will be heated by the steam in the heating chamber 824. The head cover 812 has a through hole 8124, the chamber cover 814 is penetrating through the through hole 8124, so as to be mounted with the surrounding wall 823 of the evaporation assembly 820.

Accordingly, the steam outlet holes 8222 are positioned at the lower portion of the outlet wall 8221, allowing steam to flow downward into the heating chamber 824. This design ensures that the steam is evenly distributed across the ironing board 811, leading to uniform heat transfer and effective wrinkle removal.

The surrounding wall 823 and the chamber cover 814 together define a sealed heating chamber 824. This configuration traps the steam within the chamber, maximizing thermal efficiency and reducing heat loss As a result, the ironing board 811 reaches optimal temperature more quickly, ensuring fast and effective ironing.

Figure 29:
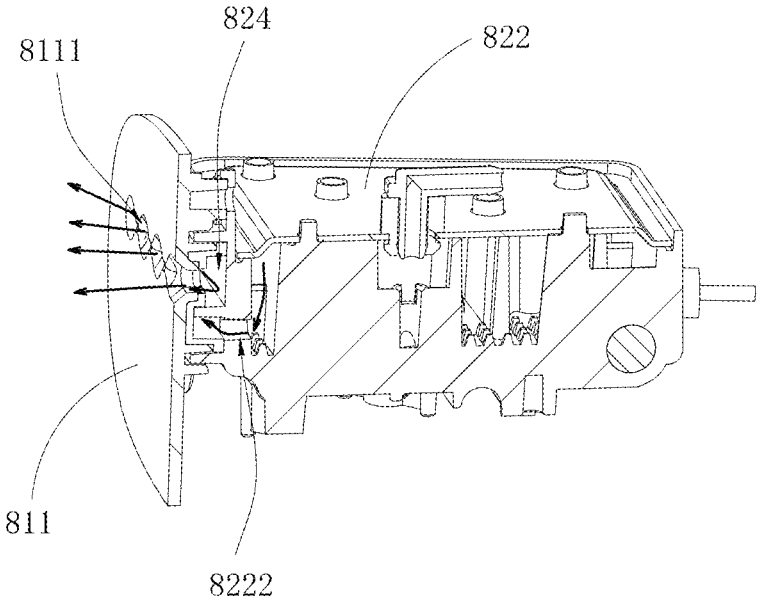
FIG. 29 is a schematic view illustrating the steam path of the ironing device according to the above preferred embodiment of the present application.
Figure 30:
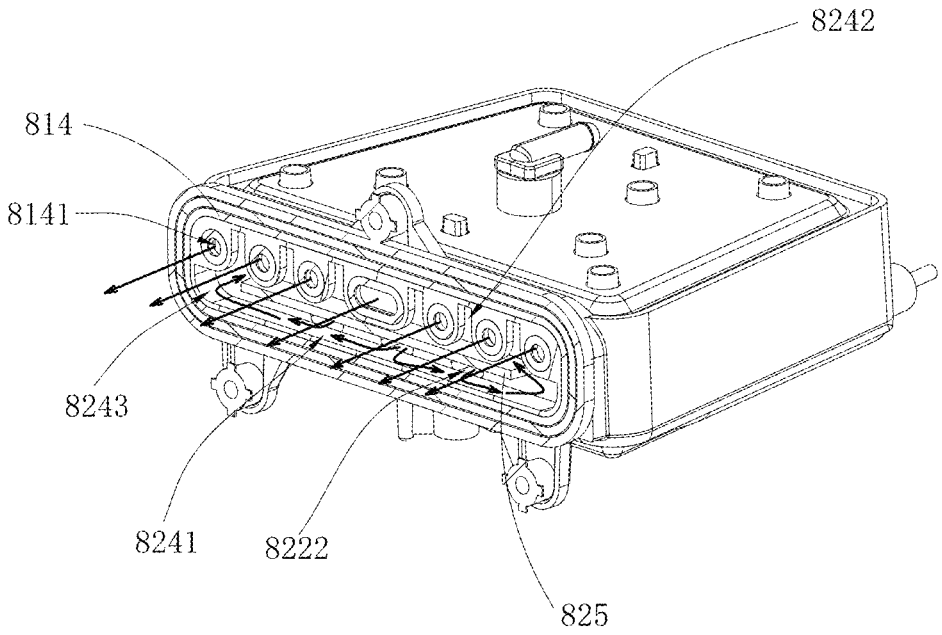
FIG. 30 is a perspective view illustrating the steam path of the ironing device according to the above preferred embodiment of the present application.

The evaporation assembly 820 further has a partition bar 825 extended from the outlet wall 8221 at a position above the steam outlet holes 8222 to divide the heating chamber 824 into a lower chamber 8241, an upper chamber 8242 and two side passages 8243 between two ends of the partition bar 825 and the surrounding wall 823, so that when the steam is released through the steam outlet holes 8222 of the outlet wall 8221, the steam will flow along the partition bar 825 in the lower chamber 8241, and then get into the upper chamber 8242 through the two side passages 8243, as shown in FIGS. 29-31.

In this embodiment, the partition bar 825 guides steam movement, forcing it to circulate within the heating chamber 824 before escaping. This prolongs the contact time between steam and the ironing board 811, maximizing heat transfer efficiency. The design minimizes wasted steam, ensuring more efficient water usage and energy conservation.

By directing steam through the lower chamber 8241 and side passages 8243 before reaching the upper chamber 8242, this ensures that the steam is evenly distributed across the entire surface of the outlet wall 8221 and the ironing board 811, preventing localized overheating or underheating.

The chamber cover 814 has one or more communication holes 8141 which are respectively aligned with the steam holes 8111 of the ironing board 811, so that the seam entering the heating chamber 824 will reach the steam holes 8111 of the ironing board 8111 through the communication holes 8141 of the chamber cover 814.

The ironing board 811 comprises a sealing wall 8113 at a rear side thereof, the sealing ring 813 is firmly coupled between the sealing wall 8113 and the head cover 812. The communication holes 8141 of the chamber cover 814 and the steam holes 8111 of the ironing board 811 are positioned at the inner side of the sealing ring 813, so as to prevent the steam leakage.

Figure 37:
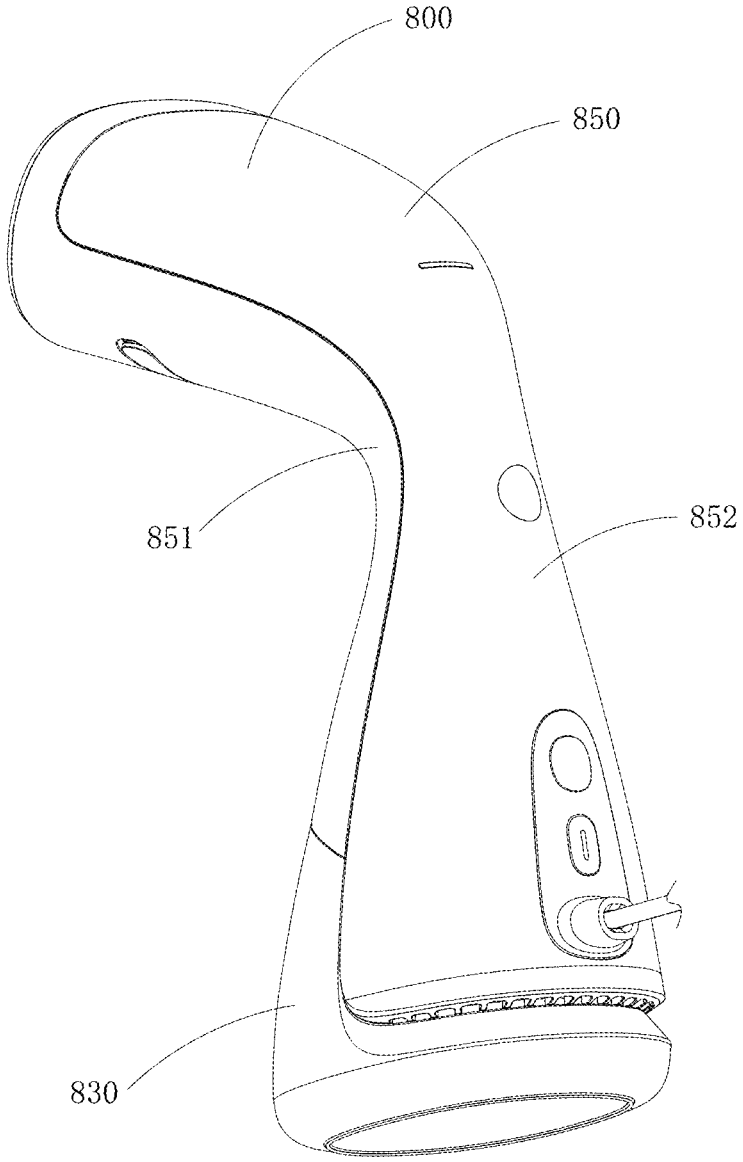
FIG. 37 is a perspective view of an ironing device according to an alternative mode of above preferred embodiment of the present application.
Figure 38:
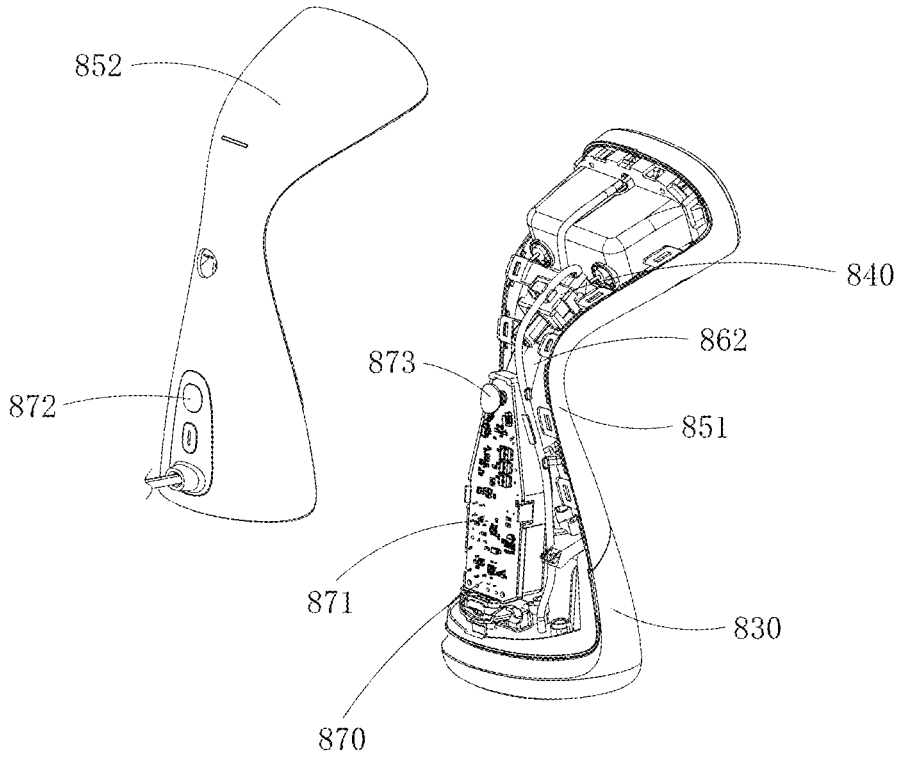
FIG. 38 is an exploded view of the ironing device according to the alternative mode of above preferred embodiment of the present application.
Figure 39:
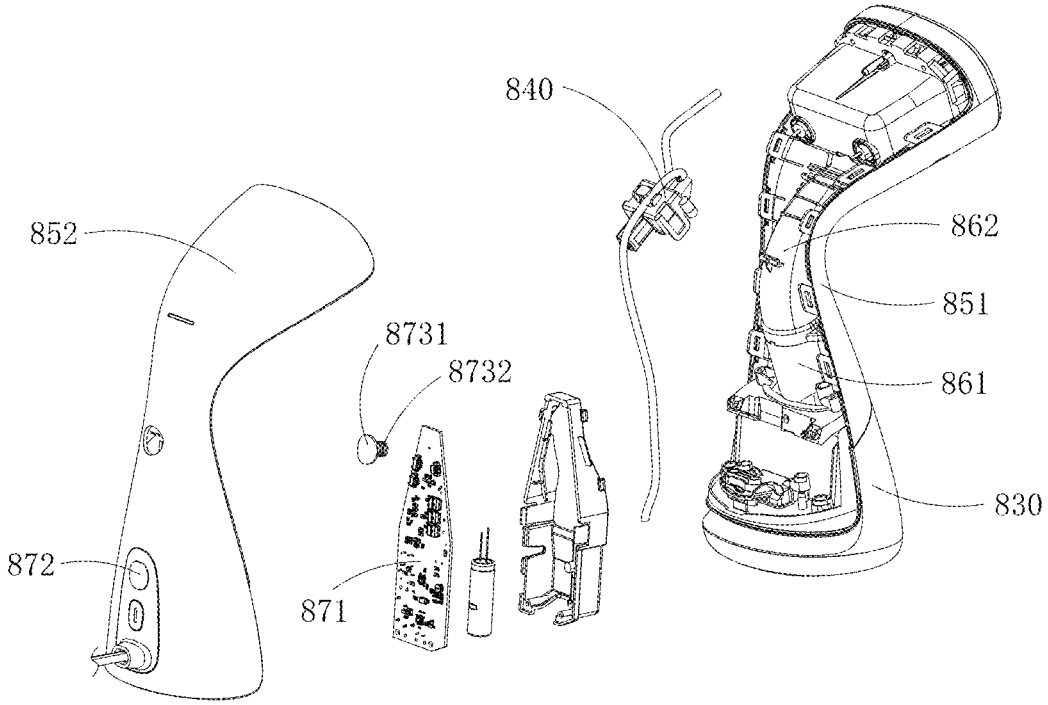
FIG. 39 is a further exploded view of the ironing device according to the alternative mode of above preferred embodiment of the present application.

Referring to FIGS. 37 to 39 of the drawings, an ironing device 800 according to an alternative mode of the above preferred embodiment of the present invention is illustrated. The ironing device 800 comprises an ironing head 810, an evaporation assembly 820, a water tank 830, a pump assembly 840 for supplying water from the water tank 830 to the evaporation assembly 820, a housing 850 and an air suction assembly 860.

In this embodiment, a control assembly 870 of the ironing device 800 is also illustrated. The control assembly 870 comprises a control circuit board 871 which is electrically connected to the evaporation assembly 820, the pump assembly 804 and the air suction assembly 860, a power switch 872 electrically connected to the control circuit board 871 for controlling the on and off the ironing device, and an operation switch 873 for controlling the operation of the pump assembly 804 and the air suction assembly 860.

Accordingly, when the power switch 872 is turned on, the evaporation assembly 820 can be activated, so as to allow the heating element 821 to be operated into a preheating mode and the ironing device is in a standby mode ready for ironing. Once the user is holding the ironing device 800 and the operate on the operation switch 873 for ironing, the pump assembly 804 and the air suction assembly 860 are in operation, so that steam can be generated in the evaporation assembly 820 and discharged through the steam holes 8111 and the air suction fan 861 is also in operation to draw air through the air suction holes 8121.

According to this embodiment, the power switch 872 provides a simple on and off control, while the operation switch 873 allows users to precisely control steam output and air suction, offering flexibility depending on the fabric type and ironing condition.

The operation switch 873 of this embodiment is a capacitive sensing switch which is electrically connected to the control circuit board 871 that is integrated with a capacitive touch controller chip, when a finger of the user approaches the surface of the housing 850 at a position aligned with the operation switch 873, the finger disrupts the electromagnetic field around the capacitive sensing switch 53 and cause a change in capacitance, and this change is detected by the capacitive touch controller chip, triggering a response such as activating the the pump assembly 804 and the air suction assembly 860.

The capacitive sensing switch comprises an sensing layer 8731 and a spring 8732 biasing against the sensing layer 8731, the spring 8732 is an electrical conductor that is electrically connected to the control circuit board 871. The sensing layer 8731 is an electrical conductor such as a copper foil that is attached to the back side of the housing 850.

Accordingly, the structure of the capacitive touch switch of the present invention comprises a sensing copper foil beneath which a spring 8732 is positioned. The spring 8732 is electrically connected to the capacitive touch controller chip. The sensing copper foil is utilized to enhance sensitivity to touch. In addition, the presence of the spring 8732 can impact the capacitive characteristics of the capacitive sensing switch. More specifically, when the spring 8732 is compressed, the capacitance change of the capacitive sensing switch is enhanced. Consequently, this can influence the responsiveness of the capacitive touch controller chip.

As shown in FIG. 39 of the drawings, the copper sensing layer 8731 can be formed as a round plate, and a diameter of the sensing layer 8731 is larger than a diameter of the elastic spring 8732.

The working principle of this structure lies in the capacitance change that occurs due to the finger placed above the sensing layer 8731 which is a copper foil, this change is then detected by the capacitive touch controller chip in the control circuit board 871, which interprets it as a touch input.

The technical advantage of this structure lies in its ability to provide sensitive and responsive touch detection. By incorporating the spring 8732 beneath the copper sensing layer 8731, the structure allows for precise detection of the finger touch through capacitance change. This enables fine-tuning of the sensitivity and responsiveness of the capacitive touch control switch of the present invention, ensuring accurate detection of touch inputs while maintaining consistent performance over time. Additionally, the use of the spring 8732 also adds mechanical resilience to the structure, enhancing its durability and longevity.

It is thus can be seen that the user can effortlessly control the ironing operation with a simple touch of his or her finger, so as to enhance user convenience. This intuitive touch-control feature streamlines the design by eliminating the need for an additional mechanical button. In other words, no mechanical button is required to be mounted in the housing 850.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. An ironing device, comprising:

a water tank;

an ironing head having a steam area and an air suction area which is positioned under said steam area;

an evaporation assembly for heating water from the water tank for generating steam which is discharged from said steam area; and an air suction fan for driving air suction through said air suction area of said ironing head wherein said ironing head comprises an ironing board having one or more steam holes to define said steam area and a head cover having a plurality of air suction holes to define said air suction area, wherein said ironing board is mounted to said head cover, said air suction holes are located under said ironing board;

wherein said ironing head further comprises a sealing ring mounted between said ironing board and said head cover.

2. An ironing device, comprising:

a water tank;

an ironing head having a steam area and an air suction area which is positioned under said steam area;

an evaporation assembly for heating water from the water tank for generating steam which is discharged from said steam area; and an air suction fan for driving air suction through said air suction area of said ironing head wherein said ironing head comprises an ironing board having one or more steam holes to define said steam area and a head cover having a plurality of air suction holes to define said air suction area, wherein said ironing board is mounted to said head cover, said air suction holes are located under said ironing board;

wherein said evaporation assembly comprises a heating element and a casing, wherein said heating element is disposed in said casing, wherein said ironing head is coupled to said casing to define a heating chamber between said ironing board and said casing to allow steam generated in said casing to enter said heating chamber to heat said ironing board;

wherein said ironing head comprises a chamber cover, said casing of said evaporation assembly comprises an outlet wall having one or more steam outlet holes, said evaporation assembly comprises a surrounding wall extended from said outlet wall, said chamber cover is coupled to said surrounding wall of said evaporation assembly to define said heating chamber.

3. The ironing device, according to claim 2, wherein said one or more steam outlet holes are formed at a lower portion of said outlet wall of said casing of said evaporation assembly.

4. The ironing device, according to claim 3, wherein said evaporation assembly further comprises a partition bar extended from said outlet wall at a position above said or or more steam outlet holes to divide said heating chamber into a lower chamber below said partition bar, an upper chamber above said partition bar, and two side passages between two ends of said partition bar and said surrounding wall for communicating said lower chamber to said upper chamber.

5. The ironing device, according to claim 4, wherein said chamber cover has one or more communication holes which is aligned with said one or more steam holes of said ironing board to communicate said upper chamber of said heating chamber to said one or more steam holes.

6. The ironing device, according to claim 5, wherein said head cover has a through hole to allow said chamber cover to pass therethrough for coupling with said surrounding wall, said ironing board comprises a sealing wall around said steam area at a rear side thereof, said ironing head further comprises a sealing ring mounted between said sealing wall of said ironing head and said head cover at a position surrounding said chamber cover.

7. The ironing device, according to claim 2, wherein said chamber cover has one or more communication holes which is aligned with said one or more steam holes of said ironing board to communicate said heating chamber to said one or more steam holes.

8. An ironing device, comprising:

a water tank;

an ironing head having a steam area and an air suction area which is positioned under said steam area;

an evaporation assembly for heating water from the water tank for generating steam which is discharged from said steam area;

an air suction fan for driving air suction through said air suction area of said ironing head; and a housing and an air suction duct disposed in said housing between said air suction area and said air suction fan;

wherein said water tank is detachably coupled to said housing to define an air guiding passage between said water tank and a bottom of said housing, wherein one or more air discharge holes is formed between said water tank and said bottom of said housing.

9. The ironing device, according to claim 8, wherein said water tank comprises a tank body and seat tank portion connected to said tank body, wherein a height of said tank body is larger than a height of said seat tank portion, wherein said housing comprises a head part and a handle part transversely extended from said head part, wherein said air guiding passage is defined between said tank body and said seat tank portion of said water tank and a bottom of said handle part, wherein said tank body and said seat tank portion are detachably coupled to said bottom of said handle part of said housing, wherein said one or more air discharge holes is positioned between said seat tank portion and said bottom of said handle part of said housing.

* * * * *